US007642915B2

(12) United States Patent
Eckstein

(10) Patent No.: US 7,642,915 B2
(45) Date of Patent: Jan. 5, 2010

(54) MULTIPLE FREQUENCY DETECTION SYSTEM

(75) Inventor: Eric Eckstein, Merion Station, PA (US)

(73) Assignee: Checkpoint Systems, Inc., Thorofare, NJ (US)

( * ) Notice: Subject to any disclaimer, the term of this patent is extended or adjusted under 35 U.S.C. 154(b) by 746 days.

(21) Appl. No.: 11/333,004

(22) Filed: Jan. 17, 2006

(65) Prior Publication Data

US 2006/0158316 A1 Jul. 20, 2006

Related U.S. Application Data

(60) Provisional application No. 60/644,690, filed on Jan. 18, 2005.

(51) Int. Cl.
*G08B 13/14* (2006.01)

(52) U.S. Cl. ..... 340/572.5; 340/572.1

(58) Field of Classification Search ..... 340/572.1, 340/572.5, 10.1

See application file for complete search history.

(56) References Cited

U.S. PATENT DOCUMENTS 4,249,167 A 2/1981 Purinton et al.
5,510,769 A * 4/1996 Kajfez et al. ..... 340/572.5
6,195,006 B1 * 2/2001 Bowers et al. ..... 340/572.1
2001/0040507 A1 11/2001 Eckstein et al.
2004/0233042 A1 11/2004 Piccoli et al.

FOREIGN PATENT DOCUMENTS

WO 00/42584 7/2000

OTHER PUBLICATIONS

International Search Report for corresponding PCT Application No. PCT/US2006/001797, dated Sep. 12, 2007.

* cited by examiner

*Primary Examiner*—Daniel Wu
*Assistant Examiner*—Shirley Lu
(74) *Attorney, Agent, or Firm*—Caesar, Rivise, Bernstein, Cohen & Pokotilow, Ltd.

(57) ABSTRACT

A multiple frequency detection system allows the seamless integration of an almost ideal EAS function with an RFID function. While not being limited to a particular theory, the preferred embodiments integrate EAS technology at, for example, 8.2 MHz or 14 MHz, and RFID technology at, for example, 13.56 MHz in a common antenna package. The use of standard RFID frequencies as forcing functions will allow for the easy packaging of EAS with RFID and have a true roadmap of a scalable technology.

25 Claims, 17 Drawing Sheets

OFFSET TARGET TEST SIMULATION
SPECTRUM OF TRANSMITTER OUTPUT
WITH PULSE WIDTH OF 0.000143 SECONDS.

FILTERING AND/OR PULSE SHAPING
(RAISED COSINE) OF TRANSMITTER
OUTPUT REQUIRED TO PASS FCC/CE
REGULATORY REQUIREMENTS.

| 1:MKR (MHz) | | Ohm | 2:MKR (MHz) | dB |
|---|---|---|---|---|
| 1: | 8.0032 | 4.3740k | | |
| 2> | 13.5622 | 1.8463k | | |

MULTIPLE FREQUENCY DETECTION SYSTEM

FIELD OF INVENTION

This invention relates to the electromagnetic field of radio frequency (RF) physics, and in particular, to loss prevention and security using radio frequency identification (RFID) and electronic article surveillance (EAS) technologies.

BACKGROUND OF THE INVENTION

The current technology uses a 8.2 MHz high frequency signal source to create a magnetic field in a bandwidth sufficient enough to match the design tolerance of the disposable targets which are built to resonant at a single frequency. The base technology of detection and deactivation has been the same for almost two decades and has reached a defacto-standard worldwide. This technology is based on the need to sell a recurring consumable to the customer in the form of a target placed on merchandize that can be detected by a security system at the perimeter of a protected area with some type of alarm that will notify store personnel if the target has not had its physical characteristics changed by a deactivated, usually integrated into a point of sale (POS) area.

The current technology makes use of an 8.2 MHz (+/− about 4%) resonant target which is either disposable in the form of a label, or of a plastic enclosure with some type of re-attachment method to the merchandise. The disposable target is in the form of paper like label and has a mechanism by which either the inductor or the capacitor can be disabled. The reusable target is in the form of a discreet purchased capacitor and manufactured coil inductor with no method of altering either of these physical properties.

Currently, there are two distinct methods of detecting targets. Both methods operate by imposing a forcing function at a range of frequencies on a closed loop wire antenna structure to induce a near magnetic (H) field. This field impinges upon the inductor of the target when the target is close (e.g., within several feet) of the antenna structure. The impinged field causes a current to flow in the coil (inductor) which, when the frequency of the impinged field, and the resonant frequency of the target are close to one another, causes a sizable current/voltage (I/V) oscillation to be set up in the target.

In the first and most widely used methodology for detecting targets, referred to as the FM/AM or Swept method of detection, one gate is used as an FM transmitter and another is used as an AM receiver. The FM transmitter is used in continuous wave (CW) operation such that the receiver sees both the forced and the natural response of the target. This method is low cost, is excellent for aisle widths up to about four feet and uses low power (e.g., <100 μuV/m @ 30 m). The detection system of the receiver can either be logic based or digital signal processing (DSP) based. Systems near each other are RF slaved or use an offset sweeping rate (FM modulation) to avoid interference.

The second methodology for detecting targets, referred to as the pulsed detection or "pulse-listen" method, uses a pulsed transmitter coupled with a homodyne AM receiver as a single gate transceiver pair. The transmitter offers a random uniform distributed set of frequencies which transfers energy to the target. The AM receiver is gated to operate quickly after the transmitter pulse negative transition. The duty cycle of the transmitter is less than about 10% with a peak radiated power of less than about 1000 μV/m @ 30 m. The receiver only responds to the natural function and is exclusively a digital signal processor (DSP) based detection system. Systems physically close to each other (e.g., closer than about 5 m) need to be synchronized to each other in order to avoid interference. Variations of the transmitter pulse mask have a modulation level (e.g., pulse) being less than 100% to allow for a continuous wave (CW) component to be generated. Other than power dissipation increases, this variation has no effect on the system.

A known system of deactivation is very similar to that of the second pulse transmitter type of sensors. The method operates on one of three principles, either always on with no receiver; on at low power, detect and alarm, and switch to high power; or on at high power, and detect and alarm if not destroyed. The frequency band of operation is the same at that of the sensors. Peak power output is less than about 1000 μV/m @ 30 m. This is the current limit set by the Federal Communications Commission (FCC) and is about 8 dB below the European Conformity (CE) limit in Europe.

Deactivation of the target is almost immediate, depending upon where the transmitter is operating in the frequency cycle. Interfacing with the POS system is provided through an interlock input which causes the transmitter to operate when a closer (optical or electrical) signal is received from the POS system. Various styles and types of antenna can be integrated with the POS system either fixed (e.g., in a counter) or portable (e.g., handheld).

The current technology has been installed in hundreds of thousands of various installations throughout the world. Several issues have been recurring with each of the technologies for the various functions (targets, sensors and deactivators). First, it must be understood that the method of system operation is not a communications system as understood in the conventional sense. The system is actually a field disturbance function which operates in an unlicensed, and unregulated (for interference) band throughout the world. For example, in EAS systems of the RF type, a transmitter functions to generate energy at a predetermined frequency which is transmitted through the transmitter antenna to establish an electromagnetic field within a surveillance zone. Typically, because of manufacturing tolerances within security tags, transmitters generate energy which is continually swept up and down within a predetermined detection frequency range both above and below a selected center frequency at a predetermined sweep frequency rate. For example, if the desired center or tag frequency to be transmitted is 8.2 MHz, the transmitter may continually sweep up and down from about 7.5 MHz to 9.0 MHz at a sweep frequency rate between 60-90 Hz.

Various standard RF noise calculations, environmental models and system simulations are not applicable to predicting real-world operation in an absolute sense. The best that can be achieved with these methods is overall system design functions. The current EAS technology limits itself in several areas. Performance is predicated on an "average" noise environment and is based upon the most common target size and signal strength. Though highly adaptable and well filtered, the system is vulnerable to environmental resonances (door frames, ceiling wiring, etc.) and therefore in practice needs to have highly trained field service technicians solve these resonances.

Reliability of system operation and quality of service (QoS) in the known EAS industry are lacking, generally because the systems are not operated on truly robust communication systems and functionality. RF has as its major issue alarm integrity, and AM has target deactivation. Both of these problems contribute to cause customers' target purchases to decline year-to-year, even when their merchandise volume grows.

A major improvement in quality of RF alarm integrity came with U.S. Pat. No. 5,510,769 to Kajfez, et al. (hereinafter "Kajfez"), the contents of which are incorporated by reference herein in its entirety. Kajfez discloses an EAS system that detects tags having two resonant frequencies critically coupled to each other. This provided an approach for utilizing the two critically coupled resonant circuits within the 7.5-9.0 MHz swept pass band of the EAS system. The system in Kajfez requires a distinct relationship between the two resonant frequencies creating a known phase amplitude relationship between the tags. While a tag in Kajfez improved the detection reliability of the prior EAS systems, the Kajfez system has its limitations. First, any perturbation of the two signals-destroys the system. That is, if one of the two signals from a tag in Kajfez is not detected, the system does not recognize the tag, which renders the system ineffective for its intended purpose. Thus the system is not immune to localized tagging effects, such as, for example, being put near metal in shopping carts, etc. Second, the Kajfez tag is formed by two resonant circuits that must be overlaid with a critical manufactured coupling between the two circuits. In other words, the Kajfez tag is actually two EAS tags manufactured and overlaid on each other, which greatly increases the cost of the target. Third, Kajfez is limited to operation with a swept type EAS system only. That is, in order to get a response of a Kajfez tag, the EAS system must sweep through the tag. In other words, the Kajfez system must have a continuous signal that electromagnetically is not discontinuous, meaning it's always on; and it changes frequency and goes through and scans through the tag to get the response.

RFID technology is looked upon as a solution for the above identified problems; however that will likely not prove to be true. First, target prices are expensive, and will likely stay that way for the foreseeable future due to the high relative cost of silicon and wafer to target (e.g., antenna) attachment process costs. Second, EAS provides a perimeter, or corral type function. While RFID can simulate this function, aisle widths for high frequency (UHF)-RFID are typically too narrow at less than one meter using 2"×2" size targets, and for ultra high frequency (UHF)-RFID systems are too unreliable (e.g., body and conductive structure detuning and target to antenna orientation) due to the physics of the RF medium employed. Therefore, RFID alone is not yet the saving grace of EAS, since it has too many technical and financial limitations for the foreseeable future.

The use of EAS (electronic article surveillance) tags and RFID (radio frequency identification) tags for a wide variety of read, track and/or detect applications is rapidly expanding. A smooth bridge between existing EAS and RFID functionality has been a consistent theme identified by users interested in RFID to allow them to obtain the benefits of RFID while maintaining their investment in EAS technology and its usefulness in protecting lower cost objects for sale that cannot justify the higher implementation cost of RFID. However, where identification tags are capable of receiving both EAS and RFID frequencies, the conventional manner in which the respective EAS or RFID signals return from these tags is processed exhibits certain shortcomings or limitations. For example, the reader for these signals comprises an 8.2 MHz EAS transceiver and a 13.56 MHz RFID transceiver in the same package that drives separate antennae via time domain switching between the two frequencies. The interference between the two technologies is handled by traditional analog signal filtering techniques. Utilizing such a configuration though, is challenging as it involves redundancy of components (i.e., duplication of transceiver components, duplication of antennae, etc.). In addition, the degree of filtering required for such a configuration is great (estimated at 100 dB) due to the very close proximity in frequency (less than 1 octave) and the relative signal amplitude differences allowable for the 2 transmission bands. Moreover, the need for two antenna for this configuration results in a much wider structure (e.g., roughly double) than for either technology deployed alone.

Even with these techniques, performance is inferior than for either technology deployed alone. The identification tag used in this related art EAS and RFID configuration includes two circuits: an RFID circuit and an EAS circuit, which are not coupled and have nothing to do with each other electromagnetically. As noted above, the system uses time domain switching, via time division multiplex (TDM), between an RFID frequency and an EAS frequency to function as a system for both. However, by switching back and forth between RFID and EAS, the combined system by definition can not provide as much processing as single stand-alone RFID and EAS systems. Therefore the combined system is not complementary and will not operate as well as either single technology systems, at least because the time switching has a tradeoff of less individual processing.

Traditionally, "pulse-listen" methodologies (e.g., transmitting a sequence of RF burst signals at different frequencies so that at least one of the frequencies bursts falls near a resonant frequency of the EAS tag) have been used in EAS but not RFID technologies, because the RFID chip requires a continuous signal emission from the reader to power the IC of the RFID tag. It would be beneficial to provide a system and method that can simultaneously detect EAS and RFID identification tag signals while avoiding the shortcomings discussed previously.

DEFINITIONS AND ABBREVIATIONS

There are a series of variables that can be measured to determine a detection threshold. These variables are either measured in the security system or on the target, and can be broken down into variables that are independent of the forcing function and geometric relation to the antenna structure and into variables that are dependant. Some exemplary variables are described below and will be used for further descriptions throughout the paper.

$F_R$: Resonant Frequency

Q: Bandwidth $T_D$: Duration of Signal ($T_D$) in detection zone $A_T$: Amplitude or Signal Strength of Target $TX_{SNR}$: Signal to noise ratio of detection environment $TX_{PWR}$: Transmitter output power $T_{SS}$: Target Signal Strength $D_V$: Detection Volume $D_Q$: Detection Quality $D_{overall}$: Overall Detection $D_{th}$: Detection Threshold $A_{T12}$: Relative amplitude differential of target $G_{T12}$: Relative phase delay between resonant frequencies $K_{R12}$: Coupling coefficient $F_R$: Resonant Frequency. In general, $F_R$ is defined as the frequency where the electromagnetic impedance of the tag transitions from a positive to a negative imaginary value passing instantaneously through only a real value. More then one $F_R$ can be present in a system. $F_R$ is an independent variable as long as the mutual coupling is negligible between the target and the sensor antenna which is only of concern in rare circumstances. For disposable targets, $F_R$ can also be effected by proximity to conductive materials and dielectrics (tag design dependant). Typically $F_R$ lowers in proximity to these materials.

Q: Bandwidth. Q is similarly to $F_R$. Q will lower (bandwidth increase) with a direct dependency on Amplitude (A) lowering as well. Effects on bandwidth are usually in the form of reduction (widening) of the bandwidth except in some specific physical cases when the target is in a particular (and unusual) proximity to a conductive surface, in some cases the signal Q is boosted (along with signal amplitude).

$T_D$: Duration of Signal (TD) in detection zone. This is a variable with a direct function of movement through the sensor (e.g., gate) area; as such it is dependant upon the type of transmitter function used and the size of the antenna structure. The function here is one of continuity over a minimum (and maximum) period of time.

$A_T$: Amplitude or Signal Strength of Target. The $A_T$ function is based upon magnetic volume and the Q of the target as well as the proximity of the target to the antenna structure. In a practical sense, amplitude ($A_T$) of a single resonant tag cannot be used as a sole detection method because it is not an independent variable, but is dependant upon the transmission power and relative position of the target to the sensor gate, therefore other variables must either be directly, or indirectly taken into account for the detection method.

$TX_{SNR}$: Signal to noise ratio of detection environment. The $TX_{SNR}$ is calculated for each system based upon the transmitter output and the threshold level of the detection subsystem. This level sets a floor (for a given detection subsystem) of detection that changes as the environment changes. Depending upon the detection method, a system (even a single pedestal) can have multiple $TX_{SNR}$ values, possible one for each antenna/frequency that the gate is using.

$TX_{PWR}$: Transmitter output power. This value is normally set at the regulatory limit, however, in some cases that may not be optimal. For example it may be preferable to increase the measure of how well the volume is served by the system by reducing the detection volume. Also, the volume is dependant upon the targets effective signal strength at a given $TX_{PWR}$.

$T_{SS}$: Target Signal Strength. $T_{SS}$ is quantity is the effective level of peak signal that a target can return given a controlled setup. For example, current common disposable and reusable targets have a $T_{SS}$ generally between about 0.25 and 9.0 times the measurement of a reference standard 1.5"×1.5" 8.2 MHz EAS tag.

Detection is the key to any EAS system. Two key metrics of detection are going to be discussed throughout this paper, Detection Volume ($D_V$) and Detection Quality ($D_Q$). These two metrics are paramount to the customer's perception of how well the system functions.

$D_V$: Detection Volume, is a measure of how well the system detects a tag anywhere in its intended detection zone. This can be measured in the classic method with the usual three carriers of a two dimensional target (front, flat and side) transferring across the detection volume in a predetermined matrix. To determine $D_V$, it is preferable to value the middle third of any aisle width at twice that of the remaining two thirds. For example, for a six foot aisle width, the middle two feet should be considered worth 67% of the overall score. The assumption here is that it is easier to detect a target located physically near the sensor gates than in the middle of the aisle and that the customer will transit through the center most often. See FIG. 1. $D_V$ preferably should be evaluated at a specific noise level, related to a threshold level. This will give a prediction function of performance (for a given target/system combination) at a given $TX_{SNR}$ level (as measured by transmitter power control and threshold level).

$D_Q$: Detection Quality, is a measure of how well the volume is served by the system. This measurement captures the ability to reject inadvertent alarms when the system is tuned at the maximum $D_V$. This measurement is a stability measurement as well as one in which the customer service engineer can judge the risk being taken at a given $D_V$. $D_Q$ is measured by having a low Q (less then 30-35) resonance added as a transiting target to the environment after the system is tuned and tested to maximum $D_V$. Again, evaluation of this must be done at a specific noise level, related to the threshold level of the detection subsystem.

$D_{overall}$: Overall Detection, is dependant upon the previous two variables ($D_V$ and $D_Q$) and gives a figure of merit and a confidence factor for determining the stability and functionality of a system given the target and environment it is functioning within as follows:

$$D_{OVERALL}=D_Q(TX_{PWR},D_{TH},T_{SS})*D_V(TX_{PWR},D_{TH},T_{SS})$$

This detection approach can also be used, with some minor modification, for RFID type systems. The resonance may be used to evaluate the system for interference. In addition, a fringe (detection volume) RFID target would be useful in determining overall functionality of the system in a multi-antenna configuration.

The FM/AM (or Swept) method of detection detects both the forcing function and the natural function of the target on the exact resonance frequency of the target. This system uses various variables of detection, but all are based upon detecting the classic "S" signature on the envelope of the FM wave. The leading "hump" is the absorption of energy from the field; the trailing is the release of the energy. Both resonant frequency $F_R$ and bandwidth Q of the target are measured with this method. Typical smoothing functions are a combination of "bucket brigade" filters (e.g., either analog or digital) and moving average (MAV) digital filtering.

Because the transmitter has a finite signal to noise ratio ($TX_{SNR}$) that is significant, especially near the carrier frequency due to phase noise, this FM/AM detection method has a finite floor limit as to aisle widths achievable between gates. This limit is inherent to the nature of any on-carrier. Also, the FM/AM detection systems have a propensity to noise induced false alarms, because the forcing function of the transmitter is always operating. This detection method is not limited to aisle distance from the $TX_{SNR}$ floor effect. It also allows the use of a single pedestal as a transceiver.

The pulsed detection method utilizes only the natural function of the target for alarm detection. The detection threshold is usually calculated at the "edge bands" of the sinusoid FM modulation signal (typically near about 7.4 and 9.0 MHz for a classic "sweep" system). The noise is only measured in the presence of the forcing function. In fact, the noise is measured when the transmitter is not enabled and on the carrier frequency that will be used as the forcing function soon after. This is an advantage in several areas for detection quality and volume.

The system is extremely immune to external noise causing false alarms. This is because the noise function and the signal detection function are separate and random in time from frame period to frame period.

BRIEF SUMMARY OF THE INVENTION

The preferred embodiments of the present invention specifically relate to a new generation of technologies which will allow the seamless integration of an almost ideal EAS function with an RFID function. While not being limited to a particular theory, the preferred embodiments integrate EAS technology at, for example, 8.2 MHz, and RFID technology at, for example, 13.56 MHz in a common antenna package. The use of standard RFID frequencies as forcing functions will allow for the easy packaging of EAS with RFID and have a true roadmap of a scalable technology.

The preferred embodiments of the present invention specifically relate to the fields of security, marketing and retail. Other embodiments of the present invention may be applied to applications including warehousing and distribution systems, manufacturing floor environments, people counting systems, product authenticity systems, supply chain diversion systems and temper sensing systems. The preferred embodiments include overall system design, detection mechanisms, target design and functions, and integration to other systems (e.g., RFID).

Lastly, the need to keep human exposure to near magnetic field radiation low will be become an important issue in the not too distant future. Human central nervous system effects, as well as implantable medical devices, will drive a social need toward common, lower power systems. The preferred embodiments address this in a number of ways as will be described in greater detail below.

According to the preferred embodiments, the invention includes a multiple frequency detection system having a reader and a resonant tag. The reader emits a pulse interrogation signal at a first frequency. The resonant tag receives the pulse interrogation signal at the first frequency and responds to the pulse interrogation signal by transmitting a first response signal resonated at the first frequency. The resonant tag further transmits a second response signal resonated at a second frequency offset from the first frequency. The reader reads one of the first and second response signals, and optionally reads the other one of the first and second response signals to detect said resonant tag.

According to the preferred embodiments, the invention also includes a multiple frequency band tag having first and second resonant circuits. The first resonant circuit includes a first inductor coil and a first capacitor and is tuned to a resonant frequency in a first frequency band. The second resonant circuit is electromagnetically coupled to the first resonant circuit, and includes a second inductor coil and a second capacitor. The second resonant circuit is tuned to a resonant frequency in a second frequency band offset from the first frequency band. The tag is adapted to respond to both a continuous interrogation signal and a discontinuous interrogation signal.

According to the preferred embodiments, the invention further includes a method for detecting a resonant tag having a first resonant circuit that is tuned to resonate a first response signal at a first frequency and having a second resonant circuit that is tuned to resonate a second response signal at a second frequency offset from the first frequency. The method includes: providing a pulsed signal to form an interrogation signal, emitting the interrogation signal to impinge on the resonant tag, transmitting the first response signal from the first resonant circuit by resonating at the first frequency in response to the interrogation signal, transmitting the second response signal from the second resonant circuit by resonating at the second frequency, reading one of the first and second response signals, and optionally reading the other one of the first and second response signals to detect the resonant tag.

According to the preferred embodiments, the invention additionally includes a multiple frequency detection system for detecting a resonant tag having a first resonant circuit that is tuned to resonate a first response signal at a first frequency and having a second resonant circuit that is tuned to resonate a second response signal at a second frequency offset from the first frequency. The system includes: means for providing a pulsed signal to form an interrogation signal, means for emitting the interrogation signal to impinge on the resonant tag, means for transmitting the first response signal from the first resonant circuit by resonating at the first frequency in response to the interrogation signal, means for transmitting the second response signal from the second resonant circuit by resonating at the second frequency, and means for reading one of the first and second response signals, and optionally reading the other one of the first and second response signals to detect the resonant tag.

Further scope of applicability of the present invention will become apparent from the detailed description given hereinafter. However, it should be understood that the detailed description and specific examples, while indicating preferred embodiments of the invention, are given by way of illustration only, and that the invention is not limited to the precise arrangements and instrumentalities shown, since the invention will become apparent to those skilled in the art from this detailed description.

BRIEF DESCRIPTION OF SEVERAL VIEWS OF THE DRAWINGS

The following detailed description of preferred embodiments of the invention will be better understood when read in conjunction with the following drawings, in which like-referenced numerals designate like elements, and wherein.

DETAILED DESCRIPTION OF THE INVENTION

While not being limited to a particular theory, the present invention is described in a system preferably using HF type technologies, not UHF. The reason is two fold. The first is that UHF technologies are easily corrupted by proximity to conductive objects (i.e. shielding and body detuning). The second is that UHF frequencies are still not globally harmonized and likely will not be in the near future. While UHF technologies are not preferred, it is understood that the scope of the invention is not limited to HF type technologies and in fact includes UHF technologies.

The preferred offset target utilizes the 13.56 MHz HF Industrial, Scientific, and Medical (ISM) band as a carrier. This carrier could be used with existing RFID systems or standalone. The offset target is preferably a single resonator type which is tuned to a frequency higher or lower than the carrier bandwidth. Detection is of the pulse type measuring the ring down (exponent) from the target envelope and bandwidth Q signal. Deactivation takes place, preferably by either a dimple or fuse type structure and a strong overload from a 13.56 MHz signal source. Obviously, this could also be used with other frequencies such as the 27.12 MHz ISM band.

The detection methods preferably measure the offset frequency of the target to make certain that an EAS specific target was measured and not an RFID target. This would be especially important is high mixed technology environments. The difficulty here to make certain that the offset is sufficient to limit false alarms from high tuned RFID targets, but is not high enough to limit the power transfer to the target. Bandwidth of the 13.56 MHz ISM band is about +/−7 KHz with an output power at approximately 15,000 uV/m. This significant power is sufficient to overcome detection concerns as long as some type of tag anti-deactivation method as known to a skilled artisan where employed.

Target cost and manufacturability of the target is similar to that of current EAS product lines. Laser trimming or some other method of precise frequency control may be needed depending upon the process method employed.

Figure 1:
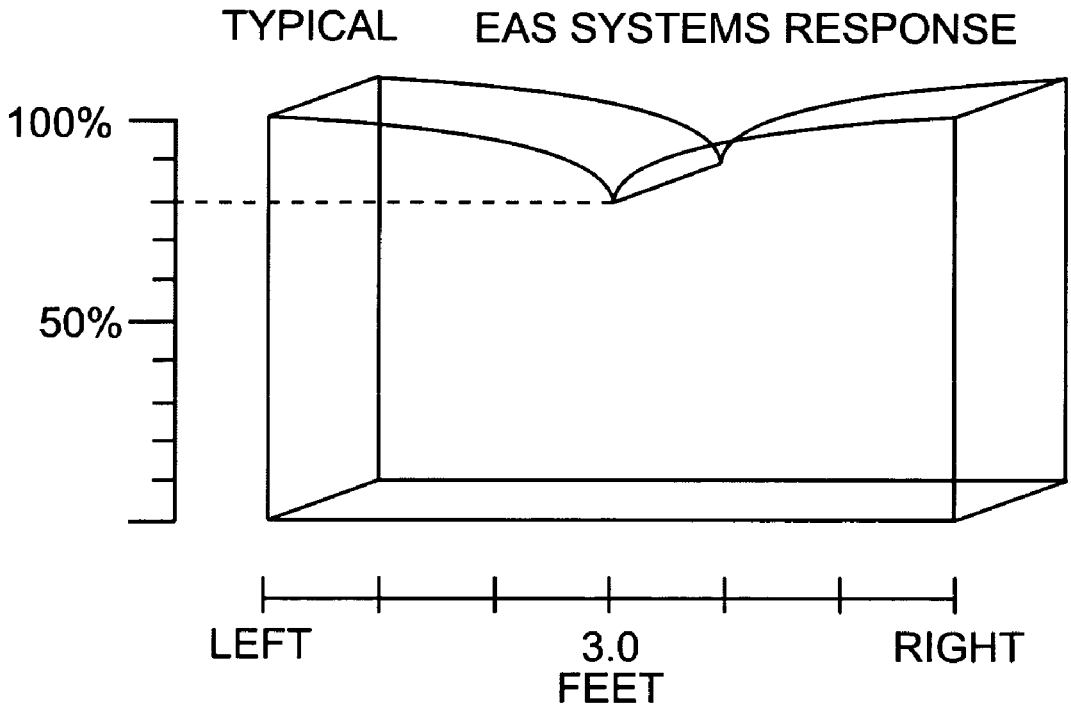
FIG. 1 shows a typical EAS systems response percentage over a six foot wide aisle width.
Figure 2:
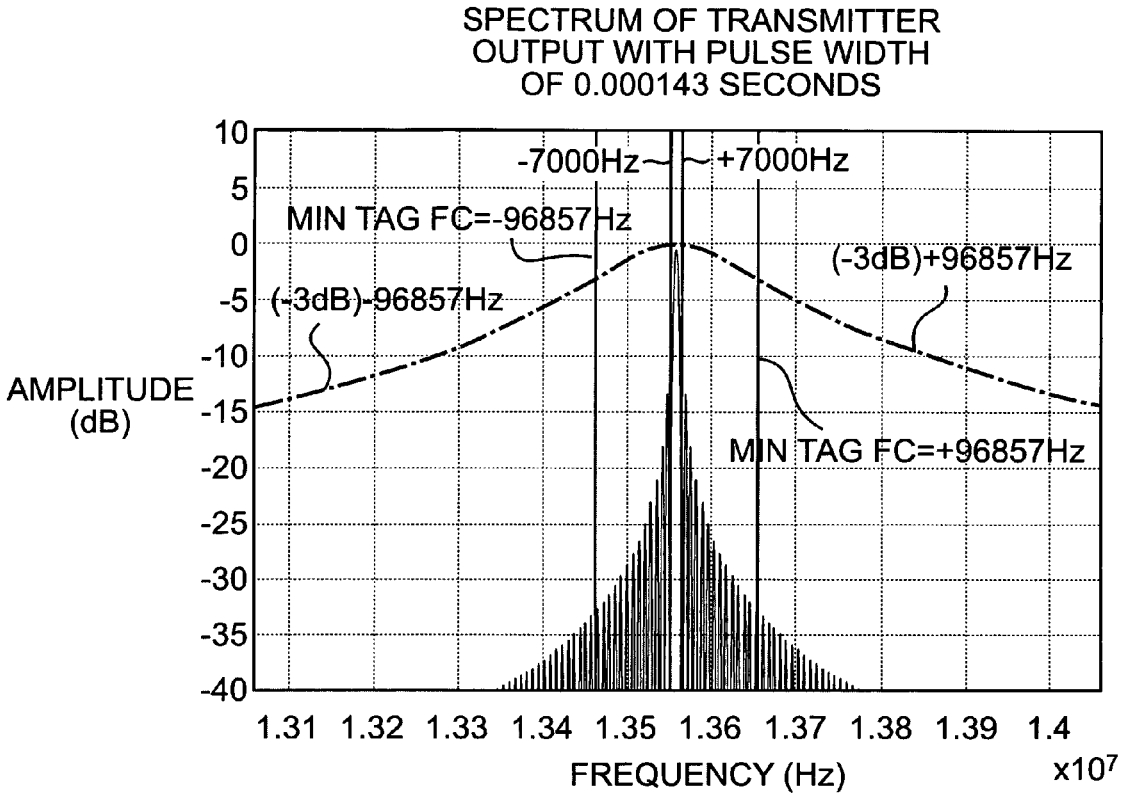
FIG. 2 shows an exemplary spectrum of transmitter output.

FIG. 2 depicts a spectrum of transmitter output at about 13.56 MHz showing exemplary results for interrogating a preferred target (e.g., tag) "on frequency" within an EAS system utilizing a "zero offset" method. This method provides the benefit of maximizing power transfer to the target. However, any RFID target at this frequency may also alarm the system. The "zero offset" overcomes this false alarm concern by triggering the alarm; not only on Frequency and Q, but also on the absence of a response signal (data) from a target.

Figure 3:
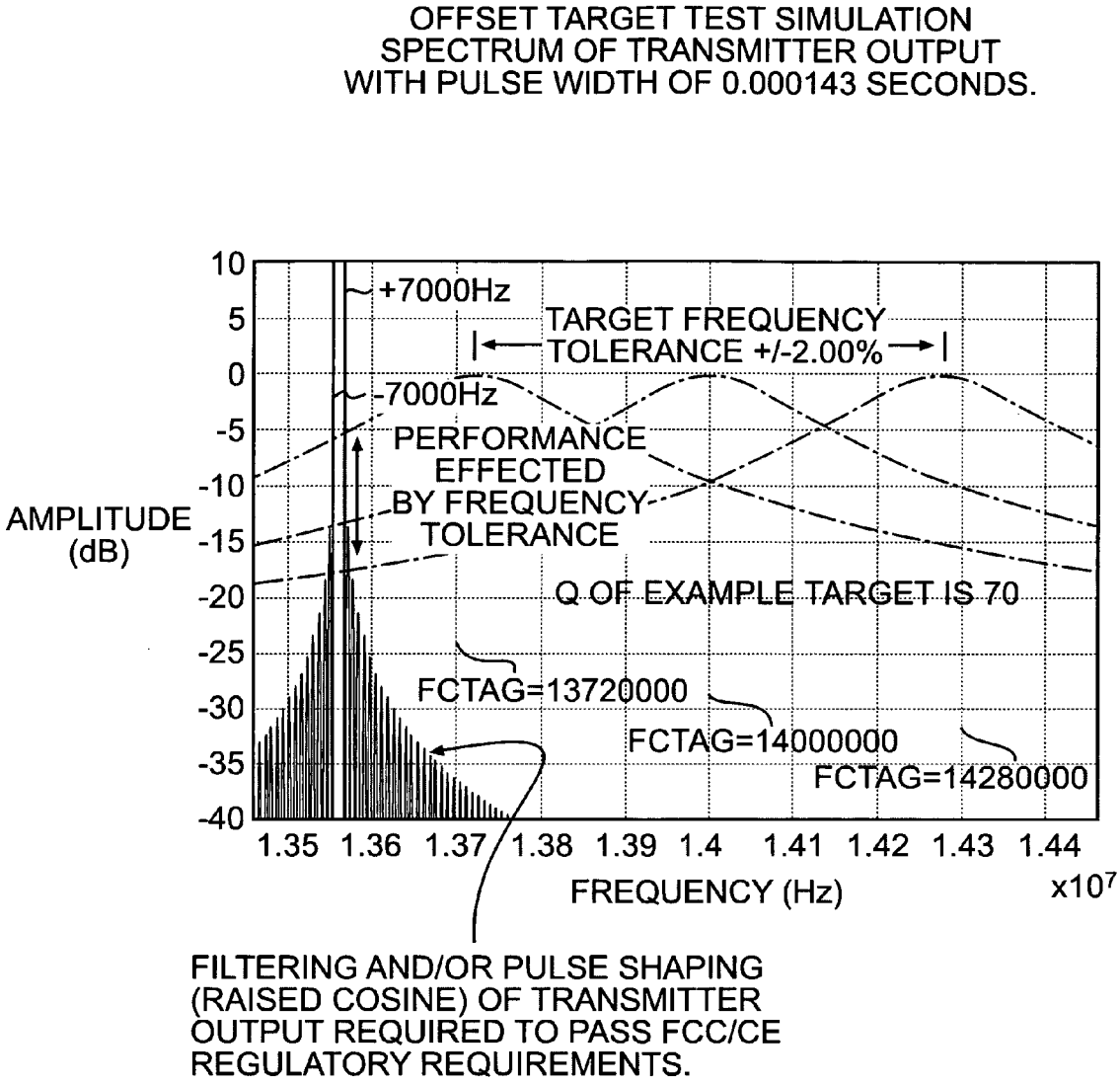
FIG. 3 shows an exemplary spectrum of transmitter output for offset targets.
Figure 4:
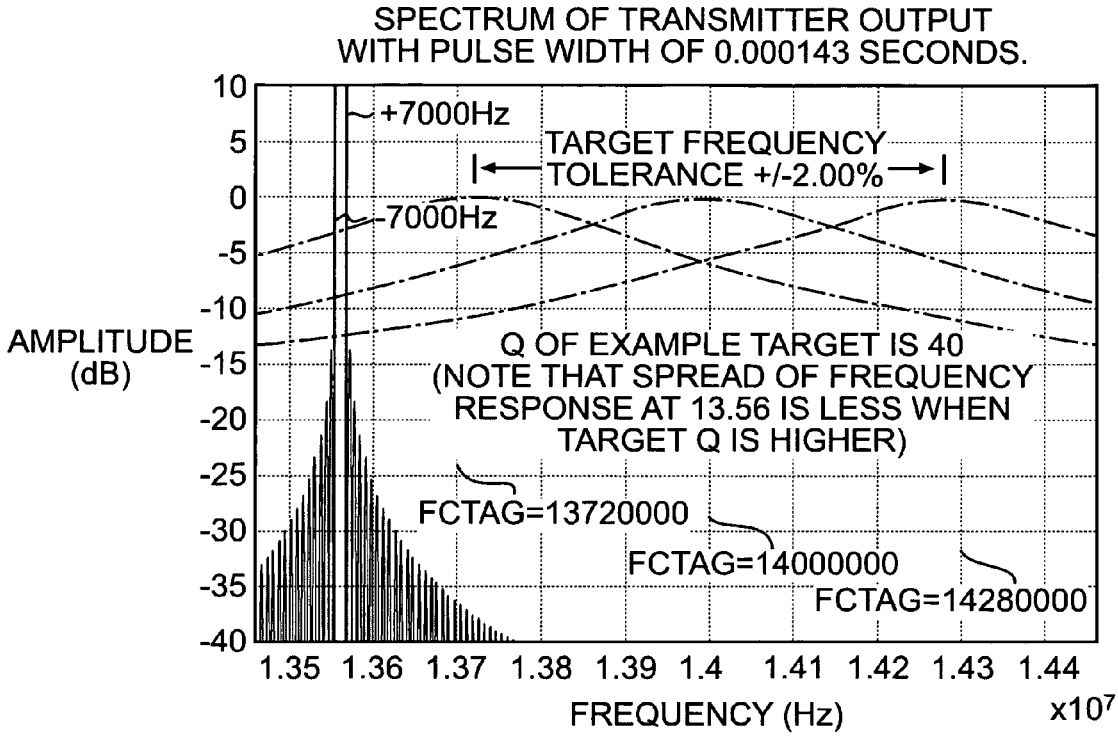
FIG. 4 shows another exemplary spectrum of transmitter output for offset targets.

An alternative to the zero offset method is a fixed offset method. This method provides the advantage of reduced concern with false positives due to RFID targets. However, the system becomes sensitive to shifts in center frequency. The sensitivity to detection is proportional to the bandwidth Q of the target. The higher the Q, the more detrimental the response, as shown by the spectrums of transmitter output for offset targets in FIGS. 3 and 4.

Upon initial review, the offset method responses may indicate that a lower bandwidth Q target would perform better for a power transfer. However, target signal strength ($T_{SS}$) is proportional to both the magnetic cross sectional area and to the bandwidth Q. Therefore, for a given sized target, maximizing Q will maximize $T_{SS}$.

In the detection systems discussed herein, there are traditionally installation concerns from resonant objects and noise sources (both environmental and co-located systems). It is thus beneficial to provide tight frequency control and bandwidth Q for the target and corresponding detection methods for both. However, as smaller tags become more prevalent, which is the trend, the bandwidth Q becomes a less controllable factor in system detection.

Merchandise resonances are exacerbated by an increase in transmitter power. In fact, resonances of merchandise and other objects may be significantly worse at 13.56 MHz than at 8.2 MHz because of the shorter wavelength involved at the higher frequency. These resonances may be minimized with a bandwidth Q measurement qualification, as a skilled artisan would readily understand.

The detection volume ($D_V$) is improved over current detection systems due at least to about a 23 dB increase in peak output power along with a relatively narrower band of detection from the controlled $F_R$ of the target. This increase is managed to perform two activities: to increase $D_Q$ under non-inductively coupled noise environments, and to decrease target package area (with a corresponding decrease in $A_T$ and Q).

Slaving between the 13.56 MHz and 8.2 MHz detection systems is available since both detection systems are preferably operated on a common single frequency. All of the transmitter pulses should be on a single frequency and since the target $F_R$ is significantly offset, crosstalk between systems is minimal.

As noted above, it is understood that the preferred embodiments are not limited to a single 13.56 MHz frequency. For example, an alternate frequency of 27.12 MHz could be used as well with slightly lower $TX_{PWR}$ from a regulatory perspective. The inherent benefit of using a system according to the preferred embodiments is that only a single processor controlled transmitter and antenna structure functions for both EAS and RFID targets, especially with some filtering and an analog receiver for the EAS portion. The filtering for the EAS targets is likely different than the filtering for the RFID receiver, but obviously a shared DSP section can be used. In a similar manner, other alternative frequencies could be used for the air protocol and RF processing. While not being limited to a particular theory, deactivation would preferably take place with a higher power POS system.

An interesting note for this system is the transparent detection of EAS targets by using the pulse profile of the RFID detection system as the power sources. This system adds little to no overhead on an RFID design other than a receiver.

An exemplary power budget for an offset frequency method is shown below in FIG. 5. This power budget is based upon a trimmed or tuned target and the maximum regulatory limit power output of the 13.56 MHz transmitter. The equation below shows the power budget equation for a detection system (assuming constant performing algorithms). For sake of this example, $T_{SS}$ is 0 dB reference for a first target and +6 dB for an auto apply target. $TX_{PWR}$ is 0 dB for an 8.2 MHz reference system and +23 dB for a reference system at the 13.56 MHz limit. $T_{OFFMAX}$ is based upon the worst case possible power transfer, for an "on frequency" system, which is 0 dB.

$$D_1 = TX_{PWR} + T_{SS} - T_{OFFMAX}$$

Figure 5:
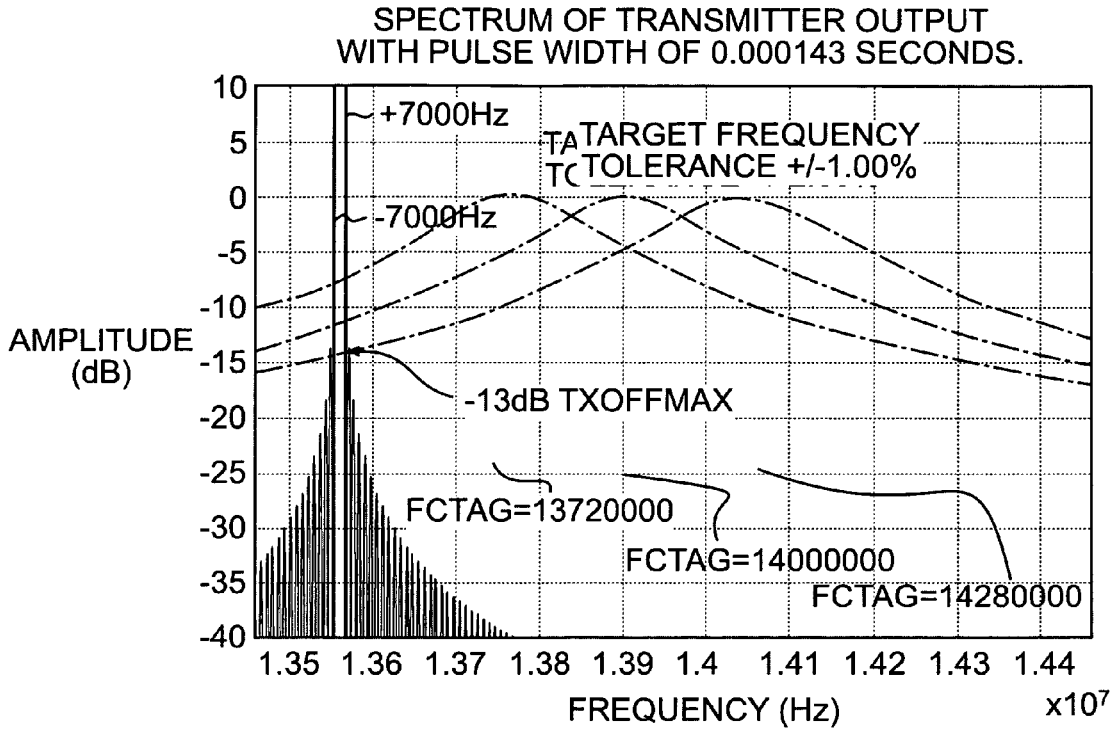
FIG. 5 shows yet another exemplary spectrum of transmitter output for offset targets.

In the spectrum of transmitter output depicted in FIG. 5, $T_{OFFMAX}$ is 13 dB. This gives a detection system power budget D1 of 23 dB+0 dB−13 dB=+10 dB. This approach of the preferred embodiments provides an additional and distinct advantage for systems using standard size targets and smaller targets. For example, a one inch by one inch sized target could be used in place of a standard 1.5"×1.5" target.

The preferred targets are dual resonant frequency $F_R$ targets which resonate at two specific $F_R$ bands (e.g., $F_{R1}$ and $F_{R2}$). The advantage of this system is that the detection quality ($D_Q$) of the system increases without penalty to the detection volume ($D_V$) because the system becomes impervious to environmental resonances and inadvertent deactivation due to high transmitter detection power systems.

While not being limited to a particular theory, one of the frequencies of this system is "on carrier" and is preferably used to maximize power transfer to the target. The secondary frequency is chosen for system convenience and operational functionality. Most of the examples disclosed herein use a primary resonant frequency ($F_{R1}$) of 13.56 MHz. The secondary frequency ($F_{R2}$) is chosen to maximize functionality, $D_Q$ and $D_V$ while keeping target and system cost at a minimum.

There are many benefits to this method. The inventor has discovered that system alarm integrity is significantly increased by a large factor due to the addition of the coupling coefficient ($K_{R12}$) between $F_{R1}$ and $F_{R2}$. A coupling coefficient $K_{R12}$ mechanism decouples the power transfer to the target from the partial signal return, as is readily understood by a skilled artisan. This decoupling means that environmental resonances which are present at $F_{R1}$ can be ignored, even if they are in motion (as in doors or merchandise being carried through the system). The receiver preferably detects the presence of $F_{R1}$ as a gating mechanism which then can be correlated with the received $F_{R2}$ to confirm the presence of an EAS target.

The system communication robustness is dramatically increased by several measurable factors. As previously mentioned the likelihood of an environmental resonance with a similar $K_{R12}$ is highly unlikely. In addition, there are several variables related to $F_{R2}$ which provide additional qualification, for example, the $F_{R2}$ frequency and Q ($Q_2$). Not so apparent is the relative amplitude differential between the target amplitude at the two frequencies (e.g., $A_{T1}$ and $A_{T2}$), hereinafter referred to as $A_{T12}$, which will always scale the same regardless of the geometric location of the target to the sensor antenna. The other variable is the relative phase delay between $F_{R1}$ and $F_{R2}$, hereinafter referred to as $G_{T12}$, which can be measured as a differential between the two exponential decay envelopes. Of course the system includes a computer that determines the variables discussed herein based on the response signals from the targets.

It should be specifically noted that environmental resonances at $F_{R2}$ will not be detected by this system, because preferably the secondary frequency $F_{R2}$ is far enough away in the frequency domain so as to not be charged by the transmitter power pulse. This makes this system inherently self-installable and very stable in terms of $D_V$ and $D_Q$.

The addition of the measurement of $K_{R12}$, $F_{R2}$, $Q_2$ and $G_{T12}$, gives the preferred embodiments an impressive quality of detection ($D_Q$) over that of the current systems. In empirical terms, each additional variable should at least half the amount of possible mechanisms to false the system. In this case there are actually three new independent variables which can be measured, $F_{R2}$, $Q_2$ and $G_{T12}$.

While not being limited to a particular theory, a target designed in accordance with the preferred embodiments could be deactivated at either the primary or secondary resonances, depending upon the regulatory ability to emit. This is another reason that the preferred secondary frequency $F_{R2}$ is, for example, about 8.2 MHz or 27.12 MHz. The obvious advantage of having it at 8.2 MHz would be the ability to use known equipment that currently exists in the market.

The basis of this technology from a detection point of view is similar to the current detection systems, but is scaled for two simultaneous resonances. Detection according to the preferred embodiments may include the additional complexity of calculating the $G_{T12}$ variable which is readily performed on the captured data.

Another benefit of the preferred embodiments is that the approach gets away from possible false alarms due to the presence of 13.56 MHz RFID targets. In addition, no slaving or other synchronizing between detections systems is needed as the received signal is significantly apart from the transmitting frequency.

Referring to the preferred targets, the coupling between the two resonant frequencies on the targets need to be quite good (>0.9) in order to facilitate power being transferred to $F_{R2}$. The mechanism for power transfer is in the form of the step response of the fundamental carrier ($F_{R1}$) which acts to "ping" $F_{R2}$ and cause is to oscillate. The amplitude of this oscillation is substantially lower than the amplitude of the forcing function (likely about 10-15 dB). However, this lower amplitude is mitigated by the increase in effective power of about +23 dB for an effective signal increase of about 8-13 dB. This can be further improved (about 6 dB) via the correlation of variables between the primary and secondary resonances.

Another benefit of the preferred embodiments is the easy adaptation to standard RFID targets. The basic RFID target only needs to have this secondary resonance added to it (FIGS. 18 & 19) to make a perimeter EAS detection system available. The perimeter detection of RFID targets, even those that only transmit an EAS "bit," have maximum aisle widths of no more then 4 feet. With the preferred embodiments, the RFID target gains an enhanced EAS functionality in terms of reliability ($D_Q$) and volume ($D_V$).

A re-activatable target may be created in accordance with the preferred embodiments through the use of a dimple which can be re-opened by a very strong $F_{R1}$ signal. In a preferred target, the dimple is constrained to a preferred area which carries a significant amount of the primary $F_{R1}$ circulation current, thereby causing an opening of the dimple at a specific power level.

As mentioned previously, the preferred embodiments of this architecture are described using the 13.56 MHz ISM frequency band. Regarding dual resonant frequency technology, the coupling of 13.56 MHz ISM and widely standard auxiliary bands (i.e. 8.2 MHz) is considered beneficial. However, it must be mentioned that 27.12 MHz and higher bands are available for use as well. The basic issue with going much higher than 13.56 MHz for a power transfer frequency is in the areas of transmitter and antenna design. For example, two known approaches for transmitter power amplifier design are a switching power supply and an RF amplifier. Using a switching power supply allows for much higher and more efficient transmitter current generation as well as lower cost component usage (e.g., Power MOSFETs as opposed to RF FETs). This also allows for efficient management pulse energy dispersal and fast receiver turn on times. However, as the systems move to higher frequencies, the more traditional RF amplifier design philosophy becomes beneficial. The components become easier and more efficient to engineer in classic RF engineering methods as the frequency gets higher.

The preferred antenna design is linked to the type of transmitter design and requires that the antenna's selfresonance point be higher than the transmitter carrier frequency in order to make an efficient current carrier. The current designs are already pushed near the forseeable limit at 13.56 MHz and very few designs have self resonance points in the 20 MHz range.

Another approach for the preferred embodiments includes the use of multiple secondary bands of detection. For example, one generic band could be used for generic perimeter EAS, while another would work on books, another on DVDs/CDs. This prime area here would be that the targets could have a primary long range (relative to other HF systems) perimeter detection and classification system that is independent of any RFID function that may exist.

The preferred embodiments provide for the integration of EAS, as a low cost, highly reliable, long range function, with RFID, as a higher cost, highly reliable, short range function. When an RFID target is read, the reliability in terms of false alarms is extremely high. However, the quality of the reads has severe limitations due to the RF physics involved. 13.56 MHz HF RFID has two main limitations: read distance, and speed oftarget acquisition in the detection field. Distance, in terms of $D_V$, is related to target size, the integrated circuit's power consumption, sensor antenna size/design, and regulatory emission and exposure limits. All of these variables are challenged as RFID moves to the item level with the severest impacts being on target size being driven smaller and strict limits on the health and safety impact of human exposure.

900 MHz UHF RFID also has two distinct limitations: read reliability and read distance. Limitations in read reliability are due to the nature of the electromagnetic properties of the frequency band being utilized. The UHF band (and higher bands as well) offer excellent "line-of-site" (LoS) communications system properties; however, line of sight (LOS) communications are also easily interrupted or perturbed by almost any conductive object placed in or near the detection zone of the sensor antenna. This makes it likely that targets that need to be detected at any specific point (e.g., the perimeter of a store for security reasons) will not be reliable and in fact easily spoofed. This perturbation effect also is linked to the read distance issue. UHF signals, unlike HF signals, are actually a fully formed propagating electromagnetic (EM) wave, (HF is still in fact only a magnetic H flux field) which have the tendency to "hitch a ride" on long conductors and effectively dramatically increase the detection volume, causing targets to be read at great distances and causing issues with understanding what target is exactly where. The read distance extension problem with UHF signals can be addressed, since it is possible to measure the turn around time of a query to target/response from the target, which effectively measures the physical distance traveled. The issue is the accuracy of the measurement since the units of measure are likely in terms of nano ($10^{-9}$) and pico ($10^{-12}$) seconds which may not be possible or cost effective given the environmental concerns. Accordingly, in view of these limitations, HF physics are preferred when a target must be specifically identified within a geographically constrained region.

This discussion of item level perimeter integration with EAS and RFID technology leads to pallet and case RFID integration. UHF is used as a standard thus far in this application due to the apparent $D_V$ and $D_Q$ benefits. However, these benefits are only valid under highly controlled environments. Larger HF targets (same size as UHF targets) function on par with UHF in both $D_V$ and $D_Q$ measurements. In fact, it is likely that HF has better metrics across a wider variety of environments than UHF.

Moreover, non-IC based targets, for a given frequency and sensor antenna design (as well as all other parameters being equal) have a significant advantage in terms of detection volume ($D_V$). With the proper design of the target and communication methodology, detection quality ($D_Q$) is equivalent to that of an RFID system. This holds true for any given frequency band utilized due mainly to the fact that no IC needs to be powered.

By using the preferred 13.56 MHz transmission field for both RFID and EAS functionality, almost all issues, from detection volume to detection quality, can be managed more readily from a developer, customer and integrator perspective. The specific air interface can either be time division multiplexed (TDM) or piggybacked on the RFID read pulses. Detection methods will vary, but a multi-resonant target has dramatically improved performance over a single-resonant one.

Since target design and manufacture is important to success of either of the above mentioned methods, the requirements and risks involved in the development of each target are discussed below.

In any case of the transmitter function, or forcing function, the target will respond with its natural function. It is possible to detect the phase shift of the forcing function as imposed on the target. This phase shift is the delay in the received energy back toward the antenna from the target at the transmitter's frequency and pulse shape. In practical terms, this delay is on the order of pico ($10^{-12}$) to femto ($10^{-15}$) seconds and difficult to measure. However, for an RFID solution, this turnaround delay time may be measurable (e.g., as a variation of time domain reflectometry (TDR) which is a widely know practice in RF engineering) when on the order of micro ($10^{-6}$) seconds or a reasonable fraction thereof. This measurement is useful in order to come up with a method of determining if UHF or microwave RFID tags are physically in close proximity to the transceiver antenna.

The function from the target is best described when the forcing function is removed. This would leave only the natural function. The coupling of this for a traditional one frequency tag is well known.

A basic multi-frequency target includes an EAS tag that resonates at two or more distinct frequencies, and thus further distinguishes the electronic signature of the target from store merchandise during Pulse-Listen detection. In addition, the preferred target includes a form of analog RFID, where different combinations of frequencies can indicate individual serial numbers. Once fabricated, the tag is stimulated at one RF frequency, and then measured for "natural ring-down" at the two (or more) resonant frequencies. While not being limited to a particular theory, the preferred tag has optimum performance when excited at 13.56 MHz, thus taking advantage of the less stringent FCC/CE regulations when operating in ISM bands.

Figure 6:
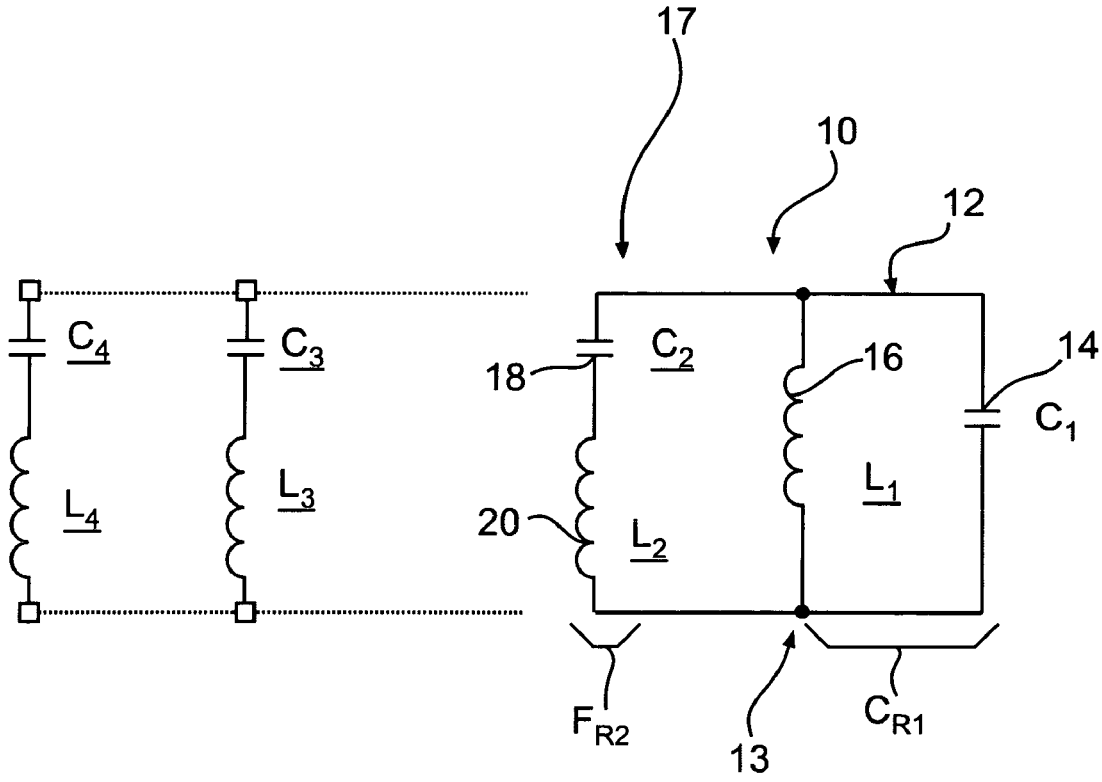
FIG. 6 is a circuit diagram of an exemplary multi-frequency tag in accordance with the preferred embodiments.

An exemplary multi-frequency tag is shown schematically in FIG. 6. The multi frequency tag 10 includes a dual frequency resonant circuit 12 having two LC circuits 13 and 17. Each LC circuit has a capacitor and an inductor, such as a capacitor 14 ($C_1$) with an inductor 16 ($L_1$) forming the first LC circuit 13, and a capacitor 18 ($C_2$) with an inductor 20 ($L_2$) forming the second LC circuit 17. The first and second LC circuits 13 and 17 are preferably coupled together on a single plane, but the tag is not limited thereto as the planar relationship between the first and second LC circuits is not critical.

While not being limited to a particular theory, the resonant circuit 12 essentially includes at least one series-resonant inductor-capacitor (LC) branch (e.g., the second LC circuit 17) in parallel with a parallel LC circuit (e.g., the first LC circuit 13). Component values of the capacitors and inductors are preferably selected such that the tag resonates at both 8.2 MHz. and 13.56 MHz. If desired, the tag 10 can be modified to include additional resonant frequencies by adding capacitors and inductors (e.g., capacitor $C_3$ and inductor $L_3$ for resonant frequency $F_{R3}$, capacitor $C_4$ and inductor $L_4$ for resonant frequency $F_{R4}$, etc.). It is within the scope of the invention to use printed circuit-substrate technology to form the tag 10. However, a multi frequency tag 10 could also be formed from known alternative structures, such as discrete inductors and capacitors fastened to a cardboard base.

In order to integrate RFID technology, an IC is coupled with the capacitor 14 ($C_1$) and the inductor 16 ($L_1$) and provides its ID when energized in a detection zone. The capacitor 14 ($C_1$) and the inductor 16 ($L_1$) provide the power for the multiple frequency tag 10, and when coupled to another resonant frequency in the tag (e.g., $F_{R2}$, $F_{R3}$, $F_{R3}$) provides its signature symbol. The signature symbol is much quicker to respond to an interrogation signal and responsive at a greater distance than the IC. Other exemplary multi-frequency tags that incorporate RFID technology are discussed in greater detail below.

Figure 7:
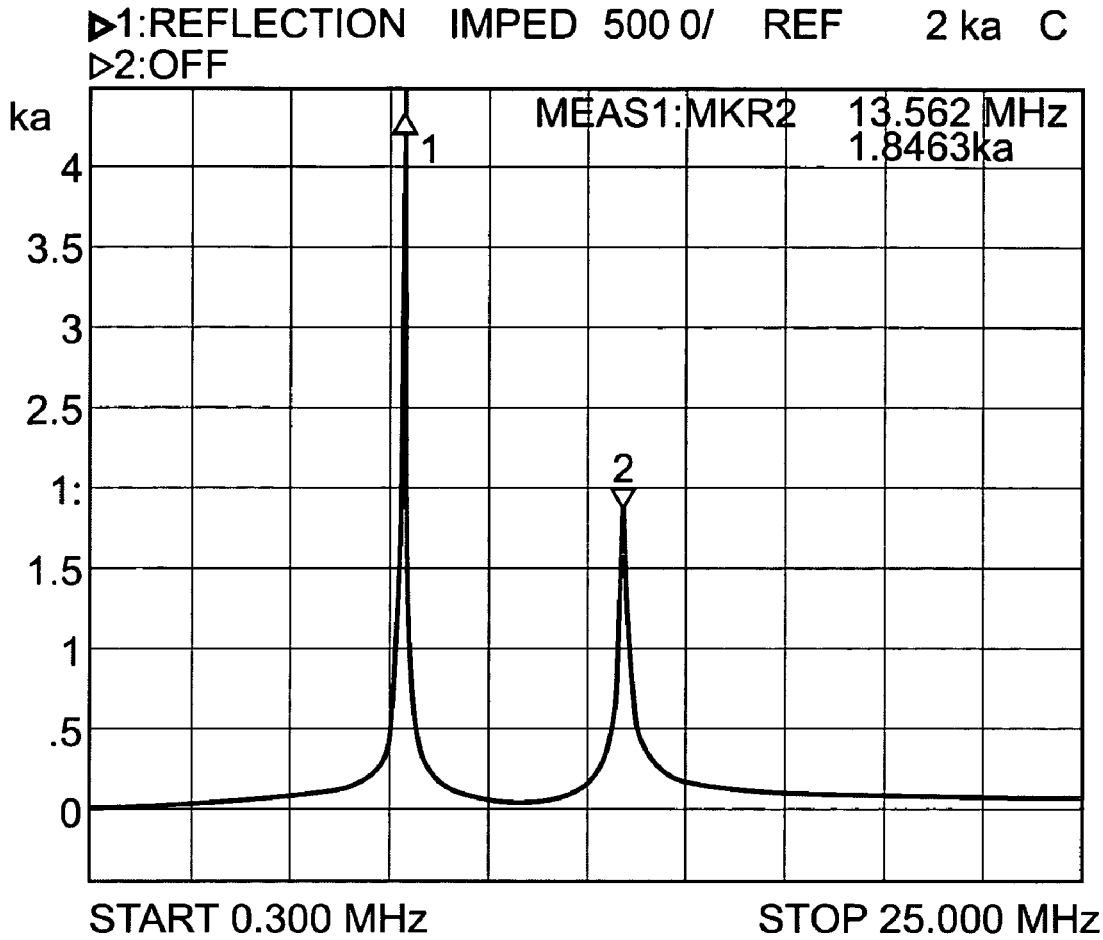
FIG. 7 is a output display showing dual resonant frequencies for a tag having circuitry as illustrated in FIG. 6.

As a skilled artisan would readily understand, the design process of the tag 10 requires a reasonable estimate of magnetic coupling between the two inductors 16, 20. Several inductors were wound and tested to establish this coupling factor. Component values of the resonant circuit 12 were selected considering the effects of this magnetic coupling, and measured for resonate frequencies using an Agilent 8712ET Network Analyzer. As illustrated in FIG. 7, an exemplary tag 10 formed with discrete inductors 16, 20 and capacitors 14, 18 resonates at about 8.003 MHz. and about 13.562 MHz.

Figure 8:
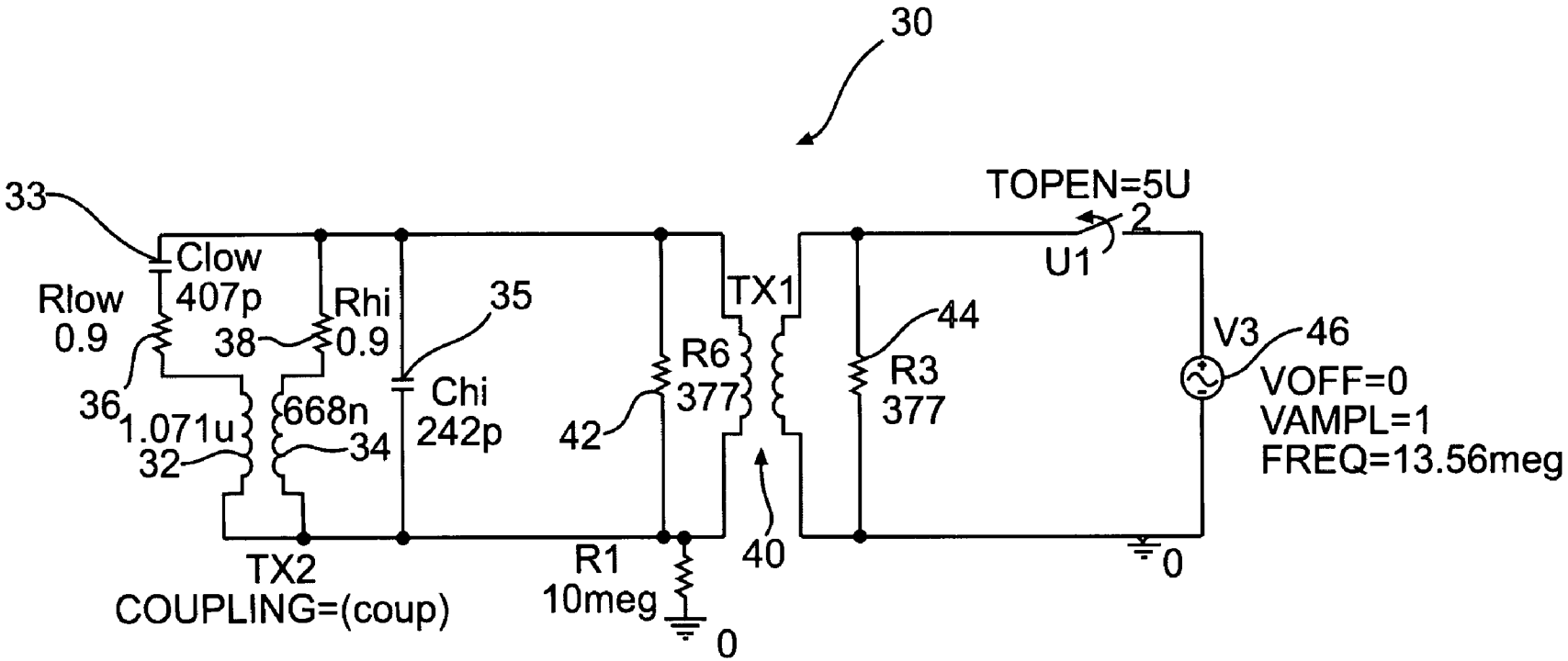
FIG. 8 is a circuit diagram of another exemplary multi-frequency tag in accordance with the preferred embodiments.

FIG. 8 depicts a circuit diagram of another multi-frequency tag 30 according to the preferred embodiments. The tag 30 includes inductors 32, 34 and capacitors 33, 35 that are similar in function to the inductors 20, 16 and capacitors 18, 14 shown in FIG. 6. In particular, the inductor 34 and capacitor 35 form a first LC circuit having a first resonant frequency, and the inductor 32 and capacitor 33 form a second LC circuit having a second resonant frequency. The inductors 32, 34 are modeled as transformer TX2, to account for magnetic coupling. The tag 30 also includes resistances 36 (Rlow) and 38 (Rhi) that estimate resistive losses in the inductor wires. The center of the schematic of the tag 30 shows a transformer 40 (TX1) having a pair of inductors and resistances 42 (R6) and 44 (R7), accounting for the coupling of the RF energy of the source antenna to the tag 30. The tag 30 also includes a voltage source 46 (V3) as the voltage source driving the source antenna. A switch 48 (U1) opens intermittently at 5 μsec. to mimic pulsed RF.

Figure 9:
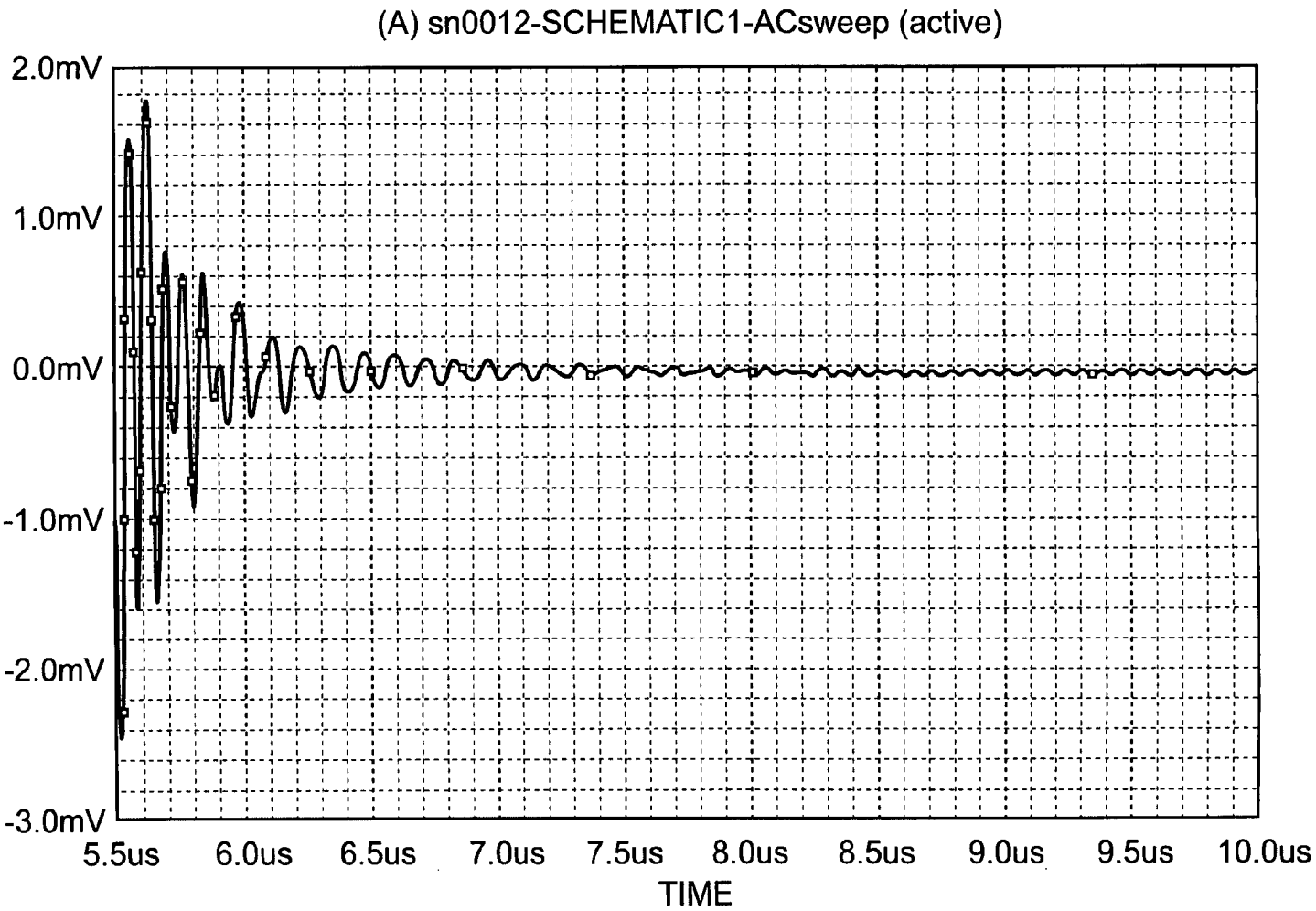
FIG. 9 shows a transient response simulated to show ring-down of a tag having circuitry as illustrated in FIG. 8.

FIG. 9 shows a transient response that was simulated to look for "ring-down" of the tag 30 once the switch 48 (U1) is opened at 5 μsec. Two distinct sinusoidal components are visible during the exponential ring-down.

Figure 10:
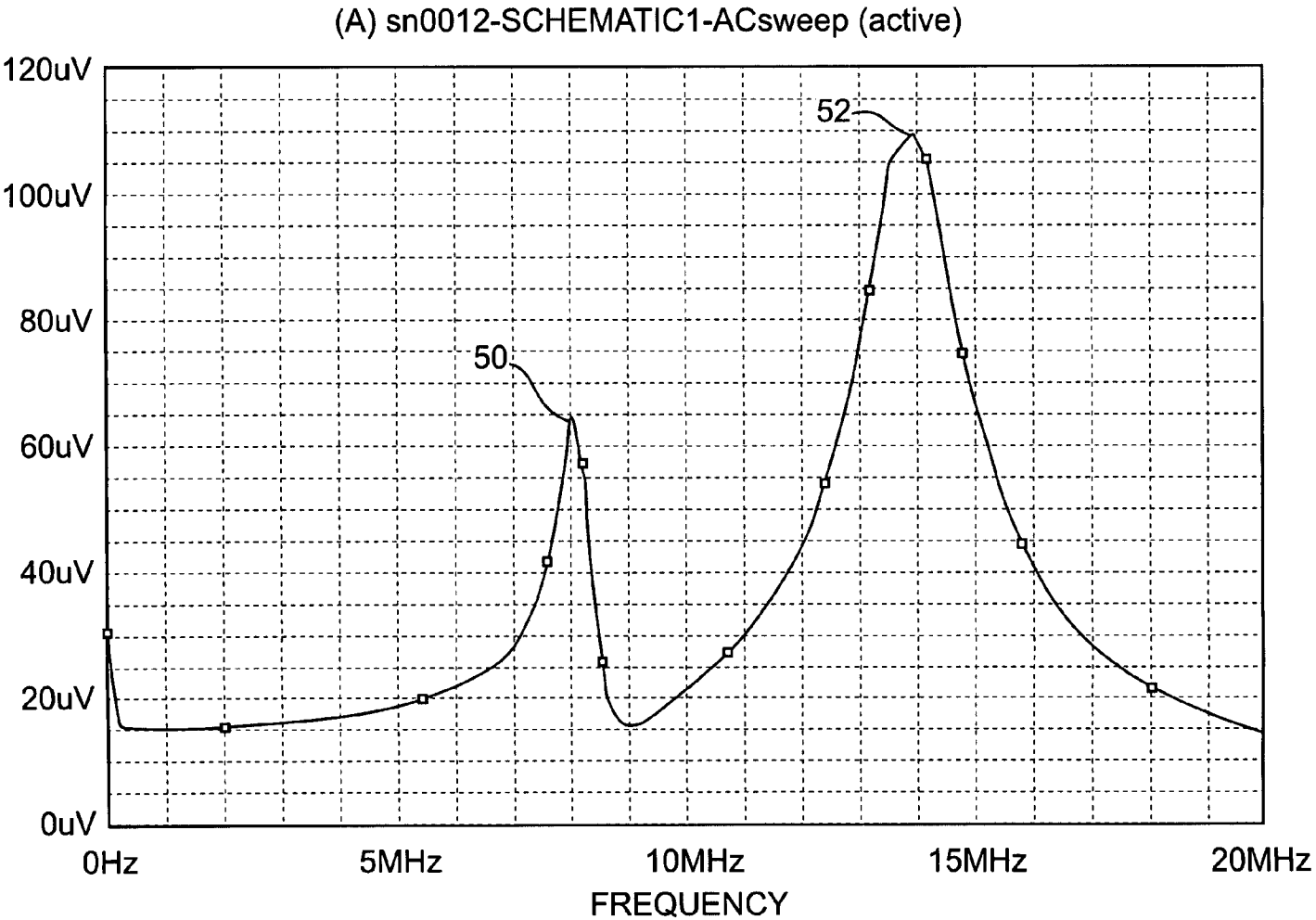
FIG. 10 illustrates results of a fast Fourier transform showing the dual frequency components of the ring down of the tag having circuitry as illustrated in FIG. 8.

FIG. 10 illustrates results of a Fast Fourier Transform (FFT) that shows spectral content. The FFT clearly shows the 8.0 and 13.56 MHz components of the ring-down at the spikes 50, 52, respectively.

Figure 11:
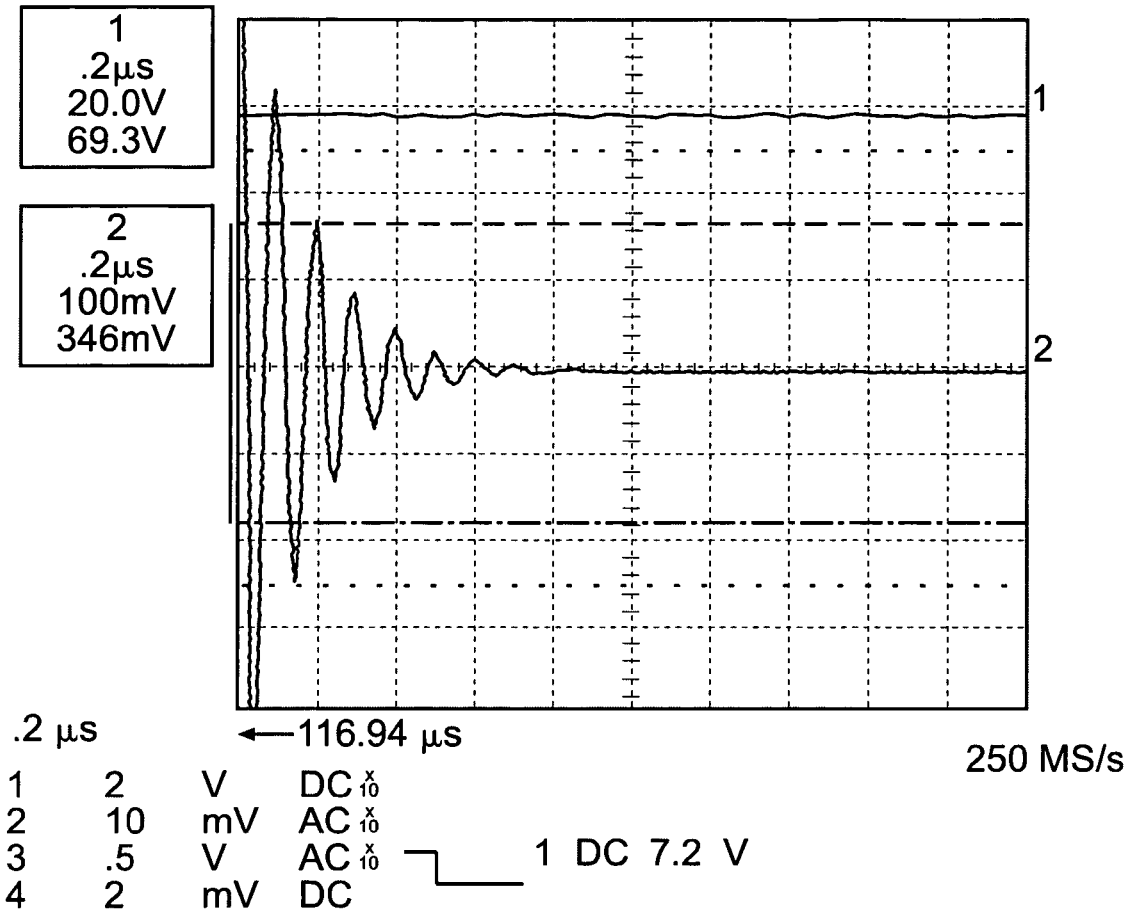
FIG. 11 shows an exemplary measurement of a residual RF field once a 13.56 MHz signal is switched off.
Figure 12:
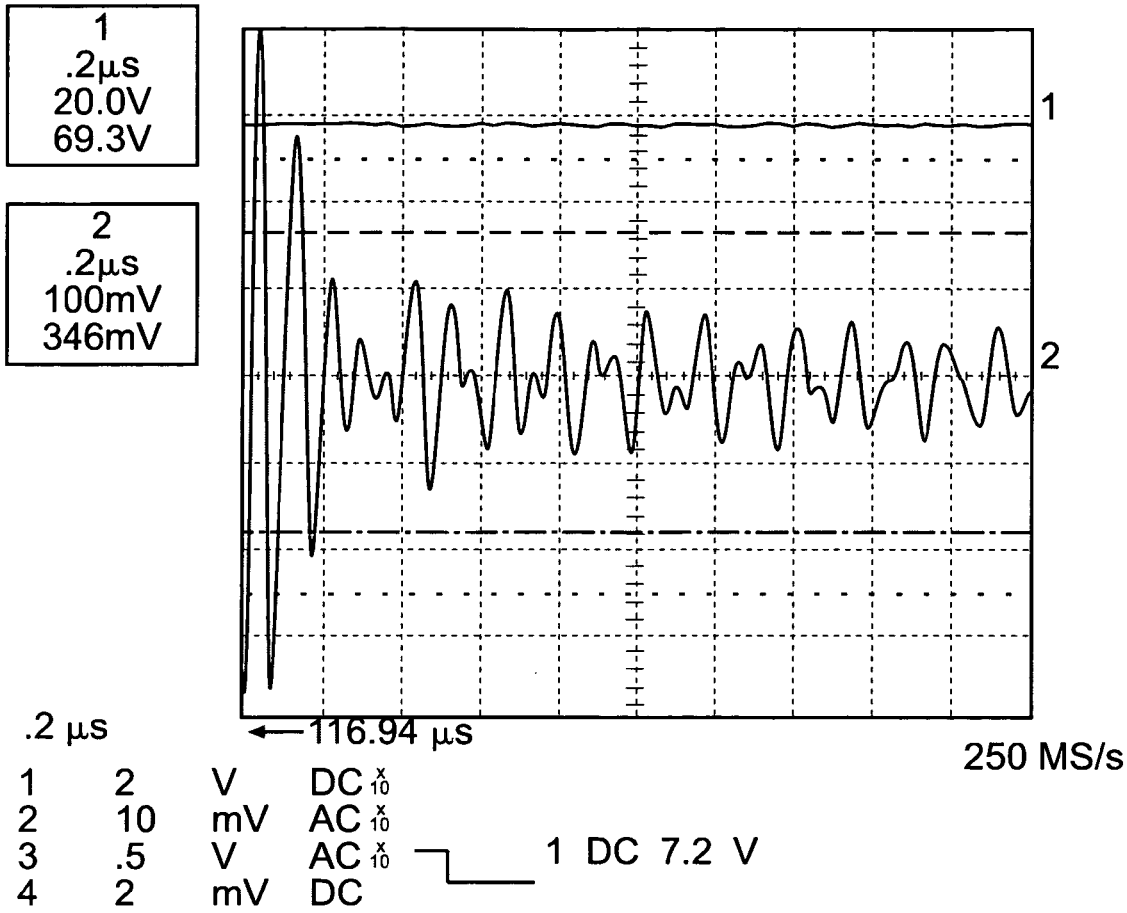
FIG. 12 shows an exemplary measurement of the residual RF field.
Figure 13:
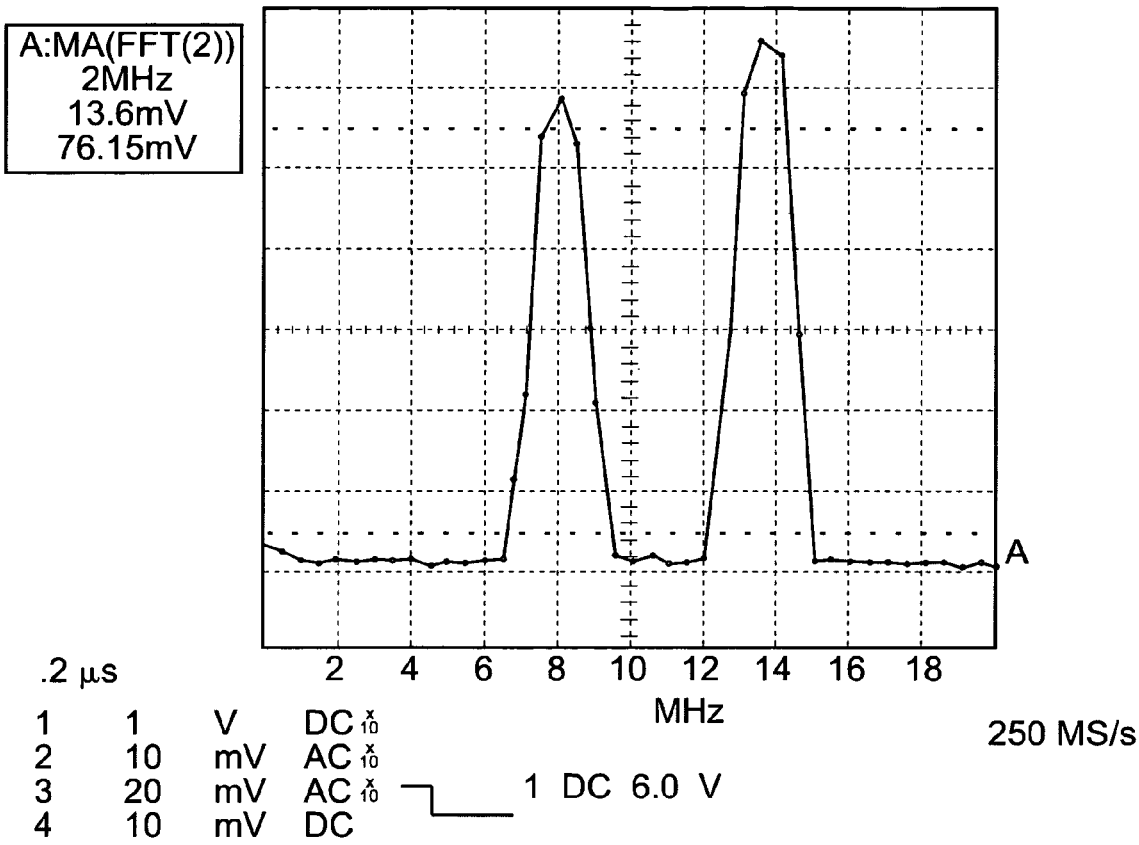
FIG. 13 shows a Fourier transformed waveform showing peaks at two different frequency bands.

FIGS. 11-13 illustrate lab measurements that show the two frequencies of the ring-down. As a baseline, FIG. 11 shows a measurement of the residual RF field once a transmitted 13.56 MHz signal was switched off. The measurement, taken by an oscilloscope and probe shows a quick transmitter decay, but no tag ring down. An exemplary multi-frequency tag in accordance with the preferred embodiments was placed in the vicinity of the antenna, and the RF field was again measured with the oscilloscope and probe. FIG. 12 shows the measurement of the residual RF field having a quick transmitter decay, but with a significant tag ring-down at about 8.0 and 13.56 MHz. This waveform was transformed into the frequency domain by using the FFT feature on an oscilloscope. The transformed waveform is shown in FIG. 13, where obvious peaks are evident at about 8.0 and 13.56 MHz.

The multi-frequency tags of the preferred embodiments can be fabricated with existing processes, and have a unique electronic signature as compared to store merchandise. Modified algorithms detect the presence of the preferred spectral content of the multi-frequency tags, thus improving alarm integrity. Detection is improved by hardware modifications to existing transceiver technology, for example, that allow for transmission at about 13.56 MHz and detection at about 8.0 to 8.2 MHz.

Figure 14:
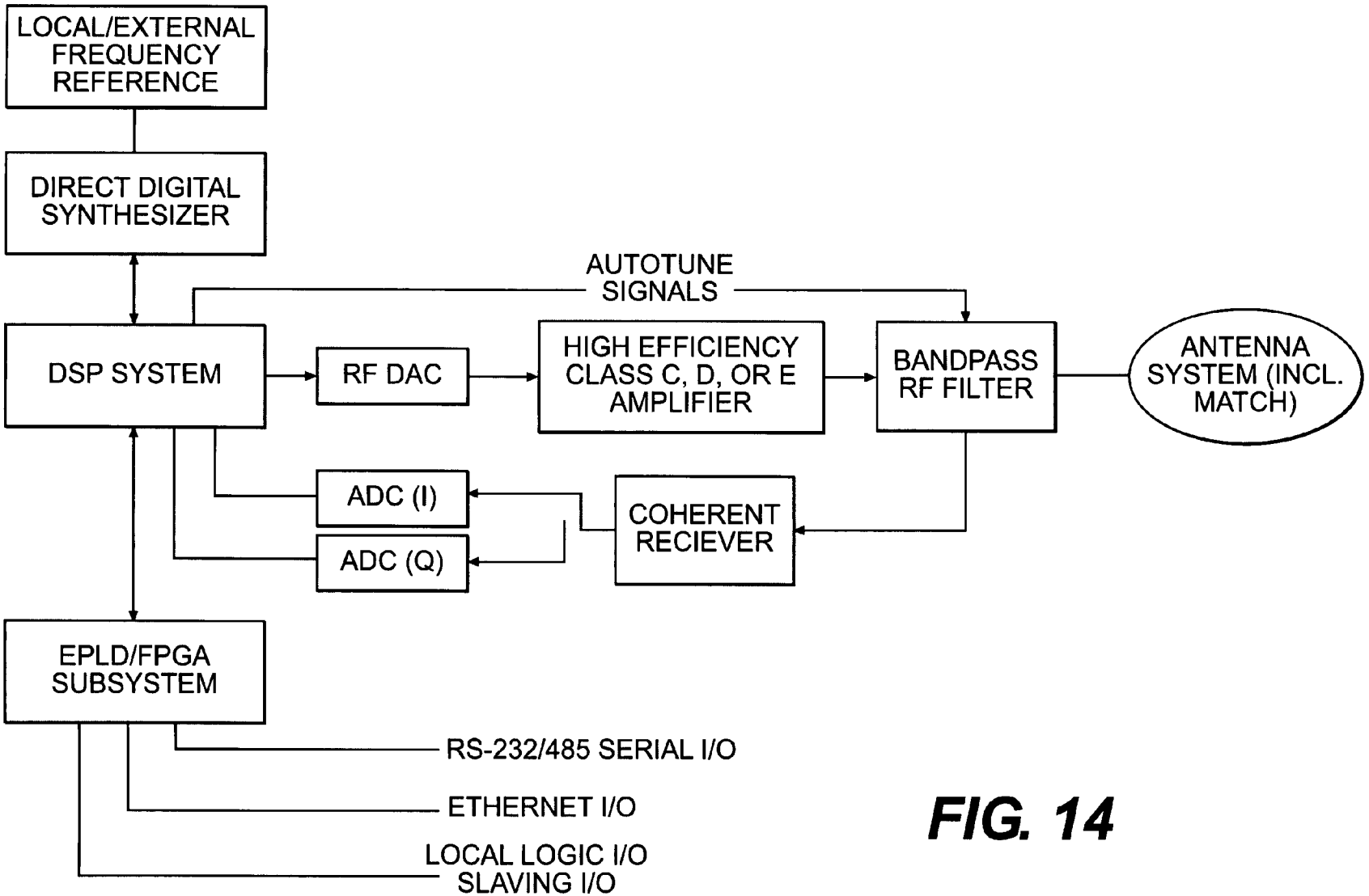
FIG. 14 is an exemplary system block diagram in accordance with the preferred embodiments.
Figure 15:
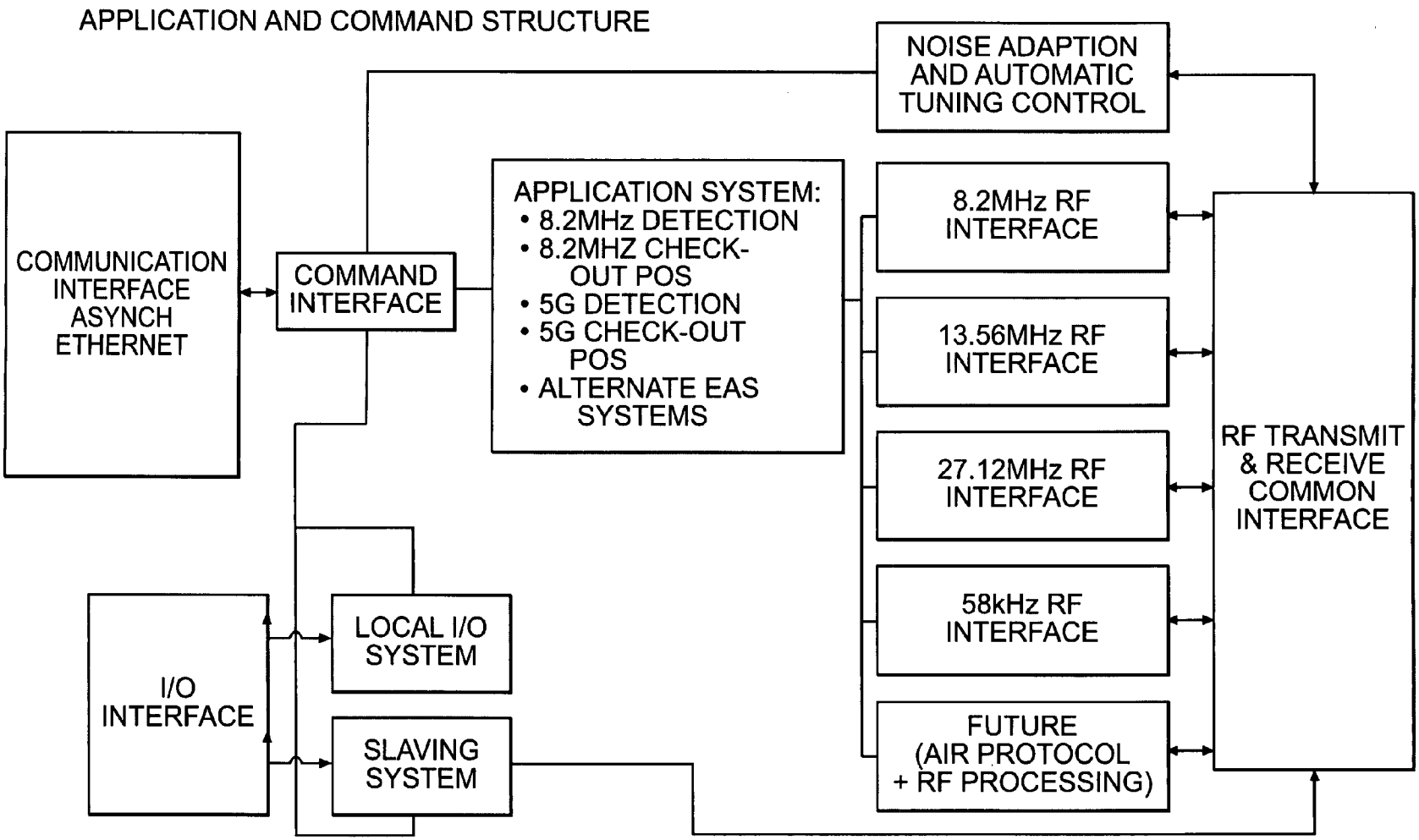
FIG. 15 is an exemplary architecture diagram of a software application layer in accordance with the preferred embodiments.
Figure 16:
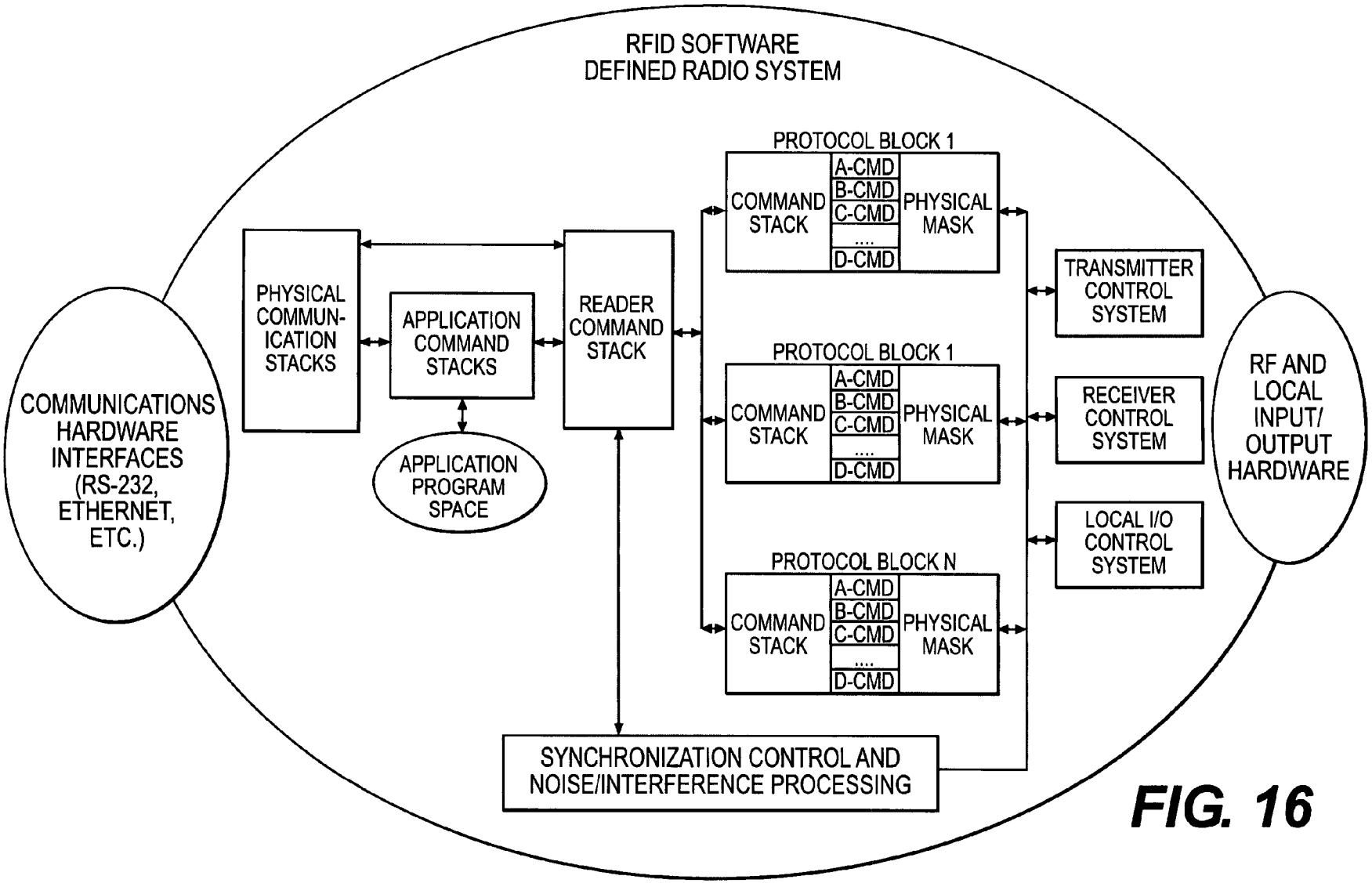
FIG. 16 is an exemplary software command and functional diagram in accordance with the preferred embodiments.

FIGS. 14-16 are shown in accordance with the preferred embodiments. In particular, FIG. 14 depicts a system block diagram showing the functional implementation of a sensor/POS device; FIG. 15 depicts a software architecture diagram of a software application layer; and FIG. 16 depicts a software command and functional diagram showing software workflow.

The system block diagram of FIG. 14 shows the overview of the implemented functional areas of the preferred detection system. This detection system will also allow any implementation of an EAS system. The limitation is only on the amplifiers frequency band and the output filter characteristics. The direct digital synthesizer allows for flexible multi-band operation, modulation, DS and FH spread-spectrum, etc. The core design of the bandpass filter and baseband demodulation is core criteria, its entire command set, and memory management, which is also internal to the DSP system. Regarding the high efficiency Class C, D or E Amplifier, the class that is used depends upon linearity, spectral purity and modulation modes, as readily understood by a skilled artisan. The FPGA allows for flexible IO and embedded uC for higher level application integration.

The software application layer diagram of FIG., 15 details the command and application flow of the system in terms of the higher level (communication and application layer) down to the physical RF interfaces (e.g., 8.2 MHz, 13.56 MHz, 27.12 MHz, 58 kHz, etc). The unique properties of this system allow integration and expansion into almost any RF communication device, including alternative EAS and even RFID devices.

The software command and functional diagram of FIG. 16 illustrates the physical software implementation work flows of the desired architecture above. This system block diagram depicts a preferred embodiment, for example, when the multiple frequency detection system is monitoring tags having two frequencies that are not reasonably close together and is still sufficiently excited by a single frequency interrogation signal. An exemplary system monitors tags having frequencies at 8.2 MHz and 13.56 MHz. It is understood that the particular frequencies are being used for ease of discussion and the scope of this example and of the invention are not limited to these specific frequencies. In this situation, it is preferred to simultaneously excite the 8.2 MHz and the 13.56 MHz signals. Referring to the system shown in FIGS. 14-16, a software defined approach is illustrated whereby even the transmitter and the receivers are completely programmable. When both frequencies are modulated at the same time, the resultant signal has a very complex wave form that is very difficult to match from an analog standpoint of view. It would be an extremely complicated circuit. A preferred circuit includes a broadband amplifier which transmits and passes both signals. Intermodulation distortion can be corrected by either predistortion or software correction before transmission, as readily understood by a skilled artisan. This linearization of amplifiers requires digital signal processors (DSPs) fast enough to be able to do this. Such fast DSPs are known. Accordingly, the preferred system can transmit an interrogation signal at both frequencies at the same time without the signals corrupting each other. A software based receiver actually receives and digitizes the wideband signal. Then, through software (or hardware that mimics the software), the receiver enables the system to receive both response signatures coming back. Accordingly, the multiple frequency detection system in accordance with the preferred embodiments can include a continuous wave (CW) 13.56 MHz system that communicates with RFID tags, and simultaneously pulses an 8.2 MHz system to see the combined signature response of the target, which resonates at both frequencies.

Figure 17:
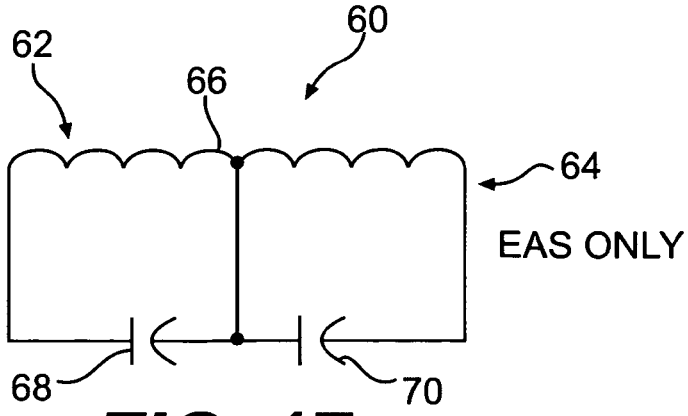
FIG. 17 is a circuit diagram of an exemplary multi-frequency EAS tag in accordance with the preferred embodiments.
Figure 18:
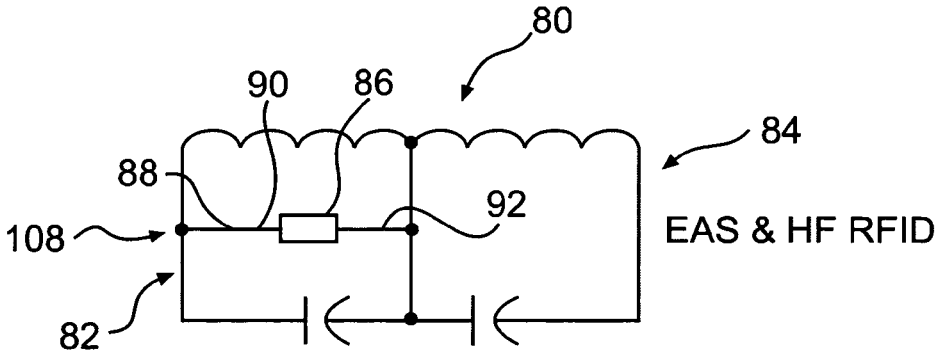
FIG. 18 is a circuit diagram of an exemplary multi-frequency EAS & RFID tag in accordance with the preferred embodiments.
Figure 19:
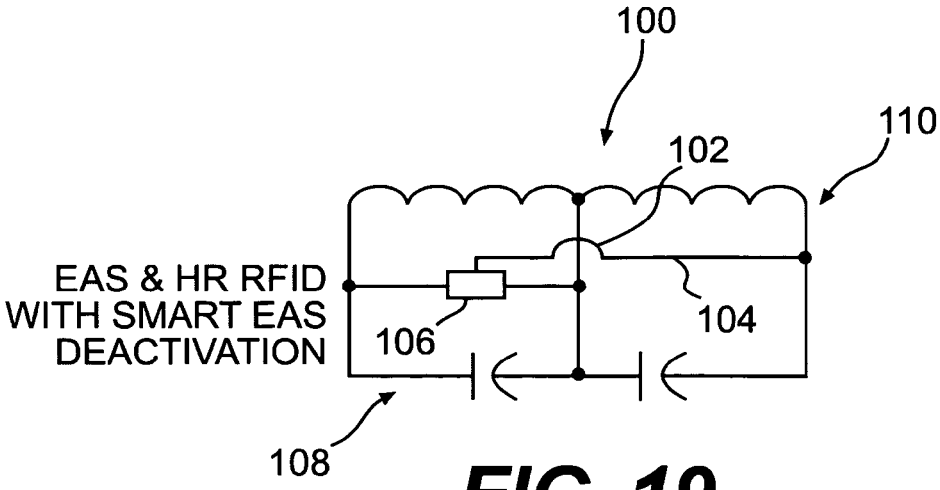
FIG. 19 is a circuit diagram of another exemplary multi-frequency EAS & RFID tag in accordance with the preferred embodiments.

FIGS. 17-19 show exemplary circuit diagrams of three variants of multi-frequency tags in accordance with the preferred embodiments. In particular, each of the circuit diagrams illustrates dual-frequency tags. Additional frequencies can be added to the tags, for example, by coupling additional resonant circuits (e.g., LC circuits) to the existing tags. An example of additional resonant circuits coupled to an existing dual-frequency tag to produce a tag resonating at additional frequencies is shown in FIG. 6.

FIG. 17 is a circuit diagram depicting an EAS only tag 60 having coupled first and second LC circuits 62 and 64, with each LC circuit resonating at a separate frequency. From an electromagnetic point of view, the tag 60 includes an inductor 66 that is tapped at two different spots with two different capacitors 68 and 70 to provide an electromagnetically coupled tag. That is, the tag 60 responds similarly to an impinged upon magnetic signature. The EAS only tag 60 is energized at a first frequency and resonates at both the first frequency and a second frequency.

FIG. 18 is a circuit diagram depicting a hybrid tag 80 that is both an EAS and a RFID tag, and also includes coupled first and second LC circuits 82, 84. The first LC circuit 82 includes an integrated circuit (IC) 86 and forms an RFID tag circuit 108. The second LC circuit 84 forms an EAS tag circuit. The IC 86 can easily be electrically mounted to the tag 60 shown in FIG. 17 during production by adding a strap 88 having the IC and wires 90, 92 to the tag 80 as shown in FIG. 18. While not being limited to a particular theory, the EAS and RFID tag 80 is preferably energized at the frequency of the RFID tag circuit 108 to energize and power the IC 86, since an RFID tag typically requires more energy than an EAS tag to power up.

As discussed above "pulse-listen" methodologies have traditionally been used in EAS but not RFID technologies, because the RFID chip requires a continuous signal emission from the reader to power the IC of the RFID tag. However, the inventor has discovered that having a transmitter output power $TX_{PWR}$ that is 23 dB higher for a reference system at the 13.56 MHz limit than for an 8.2 MHz reference system allows for a RFID chip to power up and respond with its identification. Bandwidth of the 13.56 MHz ISM band is +/−7 KHz with an output power at approximately 15,000 uV/m. It should be noted that the preferred systems would likely need to periodically switch to CW mode, however it could also not fully shut down the 13.56 MHz signal but merely step it (AM modulation as mentioned earlier) to enable the RFID tags to be powered.

Like the tag in FIG. 18, the tag depicted by a circuit diagram in FIG. 19 is a hybrid tag 100 that is an EAS and RFID tag. However, the EAS and RFID tag 100 diagrammed in FIG. 19 includes an EAS deactivation circuit 102. Preferably, the EAS deactivation circuit 102 includes a conductive member (e.g., wire 104) connecting an IC 106 of an RFID tag circuit 108 with the EAS tag circuit 110. This wire 104 adds a function on the IC 106 that is a switch to the secondary resonant circuit component of the EAS tag circuit 110 that can modify the EAS tag circuit such that the characteristic resonance no longer falls within detection parameters. The advantage of this method of deactivation (as shown, for example, in FIG. 19) is at least two fold. A first advantage is that the tag 100 could be activated and deactivated multiple times (such as when an article is returned in a store). A second advantage is the ability to require a code (linked to the ID code on the IC 106) to ensure that only authorized applications can deactivate the tag 100.

An advantage to the targets depicted in FIGS. 18 and 19 is that the base antenna structure (as in FIG. 17) could be applied to all packages, and the IC (in a carrier arrangement) could be added to only those packages as desired by the user. This would ensure that perimeter security would be available to all packages without the added complexity and cost of RFID ICs. The choice could be made latter on in the manufacturing or distribution supply chain to begin to ID the package with the addition of the IC.

Another key feature of the preferred embodiments is that the tags 60, 80, 100 shown respectively in FIGS. 17-19 are backward compatible. That is, while all of the tags shown in FIGS. 17-19 are dual frequency tags, each tag would be recognized in a stand-alone EAS or RFID system monitoring in a frequency of the tag. For example, the tag 60 diagrammed in FIG. 17 would be recognized by an EAS system monitoring at either of the frequencies of the tag. Regarding the tags 80, 100 diagrammed in FIGS. 18 and 19, if the RFID tag circuit 108 resonated at a first frequency (e.g. 13.56 MHz), and the EAS component (e.g., tag circuit 110) resonated at a second frequency (e.g., 8.2 MHz), then the tags would be recognized by both an RFID system monitoring at the first frequency and an EAS system monitoring at the second frequency regardless of whether the RFID and EAS systems were stand-alone or integrated. So, the preferred embodiments of this invention provide forward and backward compatible systems; a true bridging technology, which enables a user to migrate up and back.

Multi-frequency tags of the preferred embodiments include a signature or signature symbol in addition to its identification. While not being limited to a particular theory, the signature symbol is based on a specific combination of frequencies for each tag that further distinguishes the electronic signature of the tag. Since different combinations of frequencies can indicate individual serial numbers, and modified algorithms can detect the presence of the signature, each multi-frequency tag has a plurality of indicia (e.g., coupled responses) by which it can be identified. That is, in addition to a multi-frequency tag having its identification (ID) number stored by its IC, the tag has at least a second distinguishing mark based on its combinations of frequencies. In fact, a tag can be detected faster and at a greater distance by its signature symbol than by its IC stored ID number.

As a tag enters an interrogation field, the tag is energized by an interrogation signal and immediately responds, whereupon it is detected. The IC in the tag does not respond immediately when the tag is energized because the IC needs more time to get enough power from the interrogation signal to turn on and respond with its ID number. Thus a tag reader picks up two coupled responses, the quicker and more robust signature symbol, followed by the tag ID number. Of course the quality of the ID number, which is preferably digital, is a higher quality indicia of the tag since it is much more specific to the tag. The preferred system knows the coupled responses and has more of a likelihood of detecting and authenticating each tag.

A multiple frequency detection system in accordance with the preferred embodiments as discussed above provides the benefit and ability to detect the presence of a tag well before and under circumstances that a single frequency detection system could not identify the tag. In other words, there are circumstances (e.g., interference, insufficient power to charge the IC, not enough time as the tag moved too quickly through a detection zone) when a RFID system can't determine the ID number. If the ID number is the only detectable indicia of the tag, then the system can't determine that a tag was present. However, a preferred multiple frequency detection system can determine that a multi-frequency tag was present by detecting the tag's signature symbol.

The preferred systems can also be used for improved authentication of tagged products. Since a multi-frequency tag in accordance with the preferred embodiments gives at least two coupled identification responses, its ID and at least one signature symbol, the tag can be much more discretely identified than a single frequency tag. Accordingly, products associated with the multi-frequency tag can be much more discretely identified than products associated with single frequency tags.

In other words, the preferred embodiments provide the ability to have this signature integrated into the packaging. Once an ID is associated with a signature as could be provided in the dual-technology tags having a circuitry diagrammed, for example, in FIGS. 18 and 19, a user can record the signature through either the IC or a database. For example, a dual technology tag (e.g., a hybrid tag 80, 100) is placed on a container of pharmaceuticals with an associated signature assigned, for example, during manufacturing to a database. The signature coupled with an RFID identification number becomes the fingerprint of the container such that when someone goes to purchase the container, or a cash register checks it, or someone in quality checks it, etc., the multiple frequency detection system can literally check the container's fingerprint. Each fingerprint of each individual package can be virtually unique because of how the signature and identification are coupled and placed into the tag. So each tags individual resonant frequency, bandwidth (Q) value, phasing characteristic, and identification allows for a better system for authentication. Therefore, the system can also detect tampering, diversion, copying and even trespassing based on the location and response of the tag.

It will be appreciated by those skilled in the art that changes could be made to the embodiments described above without departing from the broad inventive concept thereof. For example, the embodiments could be modified to operate using other frequencies from the hertz band through the tera band to non-ionizing bands. Non-ionizing frequencies would work well as a coupling method differentiated by ionizing radiation as opposed to non-ionizing radiation. It is understood, therefore, that this invention is not limited to the particular embodiments disclosed, but it is intended to cover modifications within the spirit and scope of the present invention. Without further elaboration the foregoing will so fully illustrate my invention that others may, by applying current or future knowledge, readily adapt the same for use under various conditions of service.

What is claimed is:

1. A multiple frequency detection system, comprising:

a reader that emits a pulse interrogation signal at a first frequency; and a resonant tag that receives the pulse interrogation signal at the first frequency and responds to the pulse interrogation signal by transmitting a first response signal resonated at the first frequency, said resonant tag further transmitting a second response signal resonated at a second frequency offset from the first frequency, said reader further reading one of the first and second response signals, and optionally reading the other one of the first and second response signals to detect said resonant tag, wherein said reader further emits a second interrogation signal at the second frequency simultaneously with emission of the pulse interrogation signal at the first frequency, and said resonant tag transmits the second response signal at the second frequency in response to receipt of the second interrogation signal.

2. The system of claim 1, wherein said system detects said resonant tag by reading both the first response signal and the second response signal.

3. The system of claim 1, wherein the first response signal has a first amplitude and the second response signal has a second amplitude, and further comprising a computer that determines a relative amplitude differential between the first amplitude and the second amplitude.

4. The system of claim 1, further comprising a computer that determines a relative phase delay between the first response signal and the second response signal.

5. The system of claim 1, wherein said resonant tag responds to the pulse interrogation signal by simultaneously resonating at both the first frequency and the second frequency.

6. The system of claim 1, wherein said resonant tag is energized by the interrogation signal at the first frequency in order to transmit the second response signal at the second frequency.

7. The system of claim 1, said resonant tag including a first resonant circuit including a first inductor coil and a first capacitor, said first resonant circuit tuned to resonate at the first frequency, and a second resonant circuit electromagnetically coupled to said first resonant circuit, said second resonant circuit including a second inductor coil and a second capacitor and is tuned to resonate at the second frequency.

8. The system of claim 7, said first resonant circuit further including an integrated circuit to form an RFID tag circuit.

9. The system of claim 8, further comprising a deactivation circuit including a conductive member connecting said integrated circuit with said second resonant circuit.

10. The system of claim 7, wherein said first inductor coil and said second inductor coil are combined into a single inductor having a combined coil that is tapped along said combined coil to form said first and second inductor coils.

11. A method for detecting a resonant tag having a first resonant circuit that is tuned to resonate a first response signal at a first frequency and having a second resonant circuit that is tuned to resonate a second response signal at a second frequency offset from the first frequency, the method comprising:

(a) providing a pulsed signal at the first frequency to form an interrogation signal;

(b) emitting the interrogation signal to impinge on the resonant tag;

(c) transmitting the first response signal from the first resonant circuit by resonating at the first frequency in response to the interrogation signal;

(d) transmitting the second response signal from the second resonant circuit by resonating at the second frequency;

(e) reading one of the first and second response signals, and optionally reading the other one of the first and second response signals to detect the resonant tag (f) providing a second interrogation signal at the second frequency; and (g) simultaneously with step (b), emitting the second interrogation signal to impinge on the resonant tag, wherein step (d) transmits the second response signal in response to the second interrogation signal.

12. The method of claim 11, further comprising detecting the resonant tag by reading both the first and second response signals.

13. The method of claim 11, wherein the first response signal has a first amplitude and the second response signal has a second amplitude, and further comprising determining a relative amplitude differential between the first amplitude and the second amplitude.

14. The method of claim 11, further comprising determining a relative phase delay between the first response signal and the second response signal.

15. The method of claim 11, wherein step (c) and step (d) are simultaneous.

16. The method of claim 11, further comprising energizing the resonant tag with the interrogation signal at the first frequency in order to transmit the second response signal at the second frequency.

17. The method of claim 11, in step (c), further comprising transmitting the first response signal as an RFID signal.

18. The method of claim 11, in step (d), further comprising transmitting the second response signal as an RFID signal.

19. The method of claim 11, further comprising deactivating the resonant tag.

20. A multiple frequency detection system for detecting a resonant tag having a first resonant circuit that is tuned to resonate a first response signal at a first frequency and having a second resonant circuit that is tuned to resonate a second response signal at a second frequency offset from the first frequency, the system comprising:

means for providing a pulsed signal at the first frequency to form an interrogation signal;

means for emitting the interrogation signal to impinge on the resonant tag;

means for transmitting the first response signal from the first resonant circuit by resonating at the first frequency in response to the interrogation signal;

means for transmitting the second response signal from the second resonant circuit by resonating at the second frequency;

means for reading one of the first and second response signals, and optionally reading the other one of the first and second response signals to detect the resonant tag;

means for providing a second interrogation signal at the second frequency;

means for simultaneously emitting both the interrogation signal and the second interrogation signal to impinge on the resonant tag; and means for transmitting the second response signal in response to the second interrogation signal.

21. The system of claim 20, further comprising means for detecting the resonant tag by reading both the first and second response signals.

22. The system of claim 20, wherein the first response signal has a first amplitude and the second response signal has a second amplitude, and further comprising means for determining a relative amplitude differential between the first amplitude and the second amplitude.

23. The system of claim 20, further comprising means for determining a relative phase delay between the first response signal and the second response signal.

24. The system of claim 20, further comprising means for energizing the resonant tag with the interrogation signal at the first frequency in order to transmit the second response signal at the second frequency.

25. The system of claim 20, further comprising means for deactivating the resonant tag.

* * * * *

UNITED STATES PATENT AND TRADEMARK OFFICE

CERTIFICATE OF CORRECTION

PATENT NO. : 7,642,915 B2
APPLICATION NO. : 11/333004
DATED : January 5, 2010
INVENTOR(S) : Eric Eckstein It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 865 days.

Signed and Sealed this

Sixteenth Day of November, 2010

David J. Kappos

David J. Kappos
*Director of the United States Patent and Trademark Office*